US010161569B2

(12) United States Patent
Xu et al.

(10) Patent No.: US 10,161,569 B2
(45) Date of Patent: Dec. 25, 2018

(54) LED TUBE LAMP

(71) Applicant: JIAXING SUPER LIGHTING ELECTRIC APPLIANCE CO., LTD, Jiaxing (CN)

(72) Inventors: Hong Xu, Jiaxing (CN); Chang Yang, Jiaxing (CN); Shauliang Chen, Zhubei (TW); Wenjang Jiang, Jiaxing (CN); Wentao Yao, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 50 days.

(21) Appl. No.: 15/339,740

(22) Filed: Oct. 31, 2016

(65) Prior Publication Data

US 2017/0059096 A1 Mar. 2, 2017

Related U.S. Application Data

(63) Continuation-in-part of application No. PCT/CN2015/096501, filed on Dec. 5, 2015.

(30) Foreign Application Priority Data

Sep. 2, 2015 (CN) ..... 2015 1 0555543
Oct. 29, 2015 (CN) ..... 2015 1 0724263
(Continued)

(51) Int. Cl.
*F21K 9/275* (2016.01)
*F21V 29/74* (2015.01)
(Continued)

(52) U.S. Cl.
CPC ..... *F21K 9/275* (2016.08); *F21V 5/04* (2013.01); *F21V 5/043* (2013.01); *F21V 29/767* (2015.01);
(Continued)

(58) Field of Classification Search
CPC ... F21K 9/275; F21K 9/66; F21K 9/27; F21V 29/767; F21V 29/89; F21V 5/043; F21V 5/04; F21V 29/74; F21V 29/76
See application file for complete search history.

(56) References Cited

U.S. PATENT DOCUMENTS 2,454,049 A 11/1948 Floyd, Jr.
3,294,518 A 12/1966 Laseck
(Continued)

FOREIGN PATENT DOCUMENTS

CN 200980183 Y 11/2007
CN 101228393 A 11/2010
(Continued)

*Primary Examiner* — Alan Cariaso
(74) *Attorney, Agent, or Firm* — Im IP Law; C. Andrew Im; Chai Im

(57) ABSTRACT

An LED tube lamp includes a lamp tube and LED light assembly. The lamp tube includes a light transmissive portion, a reinforcing portion and an end cap. The LED light assembly includes an LED light source and an LED light strip. The light transmissive portion is fixedly connected to the reinforcing portion. The reinforcing portion includes a platform and a bracing structure. The bracing structure is fixedly connected to the platform and holds the platform in place. The LED light source is thermally and electrically connected to the LED light strip, which is in turn thermally connected to the reinforcing portion. The end cap is attached to an end of the lamp tube.

33 Claims, 15 Drawing Sheets

(30) Foreign Application Priority Data

| | | |
|---|---|---|
| Oct. 30, 2015 | (CN) | 2015 1 0726484 |
| Dec. 4, 2015 | (CN) | 2015 1 0882517 |
| Jan. 26, 2016 | (CN) | 2016 1 0050944 |
| Aug. 11, 2016 | (CN) | 2016 1 0658402 |

(51) Int. Cl.

| | |
|---|---|
| ***F21V 5/04*** | (2006.01) |
| ***F21V 29/76*** | (2015.01) |
| ***F21V 29/89*** | (2015.01) |
| *F21Y 103/10* | (2016.01) |
| *F21Y 115/10* | (2016.01) |

(52) U.S. Cl.

CPC ..... *F21V 29/89* (2015.01); *F21Y 2103/10* (2016.08); *F21Y 2115/10* (2016.08)

(56) References Cited

U.S. PATENT DOCUMENTS

| | | | | |
|---|---|---|---|---|
| 4,059,324 | A | 11/1977 | Snyder et al. | |
| 4,156,265 | A | 5/1979 | Rose | |
| 4,647,399 | A | 3/1987 | Peters et al. | |
| 5,575,459 | A | 11/1996 | Anderson | |
| 5,921,660 | A | 7/1999 | Yu | |
| 5,964,518 | A | 10/1999 | Shen | |
| 6,118,072 | A | 9/2000 | Scott | |
| 6,127,783 | A | 10/2000 | Pashley | |
| 6,186,649 | B1 | 2/2001 | Zou et al. | |
| 6,211,262 | B1 | 4/2001 | Mejiritski et al. | |
| 6,609,813 | B1 | 8/2003 | Showers | |
| 6,796,680 | B1 | 9/2004 | Showers | |
| 6,860,628 | B2 | 3/2005 | Robertson et al. | |
| 6,936,855 | B1 | 8/2005 | Harrah et al. | |
| 7,033,239 | B2 | 4/2006 | Cunkelman | |
| 7,067,032 | B1 | 6/2006 | Bremont et al. | |
| 7,594,738 | B1 | 9/2009 | Lin et al. | |
| 8,240,875 | B2 * | 8/2012 | Roberts | F21V 5/002 362/217.05 |
| 8,360,599 | B2 * | 1/2013 | Ivey | F21V 23/06 362/218 |
| 8,456,075 | B2 | 6/2013 | Axelsson | |
| 8,579,463 | B2 | 11/2013 | Clough | |
| 9,000,668 | B2 | 4/2015 | Qiu | |
| 9,322,531 | B2 | 4/2016 | Liang et al. | |
| 9,335,008 | B2 | 5/2016 | Fujita et al. | |
| D761,216 | S | 7/2016 | Jiang | |
| 9,447,929 | B2 | 9/2016 | Jiang | |
| D768,891 | S | 10/2016 | Jiang et al. | |
| 9,611,984 | B2 | 4/2017 | Jiang et al. | |
| 9,618,166 | B2 | 4/2017 | Jiang et al. | |
| 9,618,168 | B1 | 4/2017 | Jiang et al. | |
| 9,625,129 | B2 | 4/2017 | Jiang et al. | |
| 9,625,137 | B2 | 4/2017 | Li et al. | |
| D797,323 | S | 9/2017 | Yang et al. | |
| 2002/0044456 | A1 | 4/2002 | Balestriero | |
| 2003/0231485 | A1 | 12/2003 | Chien | |
| 2004/0095078 | A1 | 5/2004 | Leong | |
| 2004/0189218 | A1 | 9/2004 | Leong | |
| 2005/0128751 | A1 | 6/2005 | Roberge | |
| 2005/0162850 | A1 | 7/2005 | Luk | |
| 2005/0207166 | A1 | 9/2005 | Kan | |
| 2005/0213321 | A1 | 9/2005 | Lin | |
| 2007/0001709 | A1 | 1/2007 | Shen | |
| 2007/0145915 | A1 | 6/2007 | Roberge | |
| 2010/0253226 | A1 | 10/2010 | Oki | |
| 2010/0277918 | A1 | 11/2010 | Chen et al. | |
| 2015/0098230 | A1 * | 4/2015 | Tamura | F21K 9/1355 362/382 |
| 2016/0091147 | A1 | 3/2016 | Jiang et al. | |
| 2016/0091156 | A1 | 3/2016 | Li et al. | |
| 2016/0091179 | A1 | 3/2016 | Jiang et al. | |
| 2016/0102813 | A1 | 4/2016 | Ye et al. | |
| 2016/0178135 | A1 | 6/2016 | Xu et al. | |
| 2016/0178137 | A1 | 6/2016 | Jiang | |
| 2016/0178138 | A1 | 6/2016 | Jiang | |
| 2016/0198535 | A1 | 7/2016 | Ye et al. | |
| 2016/0212809 | A1 | 7/2016 | Xiong et al. | |
| 2016/0215936 | A1 | 7/2016 | Jiang | |
| 2016/0215937 | A1 | 7/2016 | Jiang | |
| 2016/0219658 | A1 | 7/2016 | Xiong et al. | |
| 2016/0219666 | A1 | 7/2016 | Xiong et al. | |
| 2016/0219672 | A1 | 7/2016 | Liu | |
| 2016/0223180 | A1 | 8/2016 | Jiang | |
| 2016/0223182 | A1 | 8/2016 | Jiang | |
| 2016/0229621 | A1 | 8/2016 | Jiang et al. | |
| 2016/0255694 | A1 | 9/2016 | Jiang et al. | |
| 2016/0255699 | A1 | 9/2016 | Ye et al. | |
| 2016/0270163 | A1 | 9/2016 | Hu et al. | |
| 2016/0270164 | A1 | 9/2016 | Xiong et al. | |
| 2016/0270165 | A1 | 9/2016 | Xiong et al. | |
| 2016/0270166 | A1 | 9/2016 | Xiong et al. | |
| 2016/0270173 | A1 | 9/2016 | Xiong | |
| 2016/0270184 | A1 | 9/2016 | Xiong et al. | |
| 2016/0290566 | A1 | 10/2016 | Jiang et al. | |
| 2016/0290567 | A1 | 10/2016 | Jiang et al. | |
| 2016/0290568 | A1 | 10/2016 | Jiang et al. | |
| 2016/0290569 | A1 | 10/2016 | Jiang et al. | |
| 2016/0290570 | A1 | 10/2016 | Jiang et al. | |
| 2016/0290598 | A1 | 10/2016 | Jiang | |
| 2016/0290609 | A1 | 10/2016 | Jiang et al. | |
| 2016/0295706 | A1 | 10/2016 | Jiang | |

FOREIGN PATENT DOCUMENTS

| | | | |
|---|---|---|---|
| CN | 102121690 | A | 7/2011 |
| CN | 201954169 | U | 8/2011 |
| CN | 202120982 | U | 1/2012 |
| CN | 202125774 | U | 1/2012 |
| CN | 102359697 | A | 2/2012 |
| CN | 102518972 | A | 6/2012 |
| CN | 202392485 | U | 8/2012 |
| CN | 202546330 | U | 11/2012 |
| CN | 103016984 | A | 4/2013 |
| CN | 103195999 | A | 7/2013 |
| CN | 203162856 | U | 8/2013 |
| CN | 201866575 | U | 10/2013 |
| CN | 203240337 | U | 10/2013 |
| CN | 203240362 | U | 10/2013 |
| CN | 203384716 | U | 1/2014 |
| CN | 203413396 | U | 1/2014 |
| CN | 203453866 | U | 2/2014 |
| CN | 203517629 | U | 4/2014 |
| CN | 203585876 | U | 5/2014 |
| CN | 203615110 | U | 5/2014 |
| CN | 103943752 | A | 7/2014 |
| CN | 204083927 | U | 1/2015 |
| CN | 204268162 | U | 4/2015 |
| CN | 204300737 | U | 4/2015 |
| CN | 104595765 | A | 5/2015 |
| CN | 204420636 | U | 6/2015 |
| JP | 3147313 | U | 12/2008 |
| JP | 2013254667 | A | 12/2013 |
| WO | 2009111098 | A2 | 9/2009 |
| WO | 2011/132120 | A1 | 10/2011 |
| WO | 2013/125803 | A1 | 8/2013 |
| WO | 2013147504 | A1 | 10/2013 |
| WO | 2014/001475 | A1 | 1/2014 |
| WO | 2015/036478 | A1 | 3/2015 |

* cited by examiner

LED TUBE LAMP

RELATED APPLICATION

This is a continuation-in-part application of International Application PCT/CN2015/096501, with an international filing date of Dec. 5, 2015. The present application claims the benefit of the following Chinese Patent Applications: CN201510555543.4 filed Sep. 2, 2015; CN201510724263.1 filed Oct. 29, 2015; CN201510726484.2 filed Oct. 30, 2015; CN201510882517.2 filed Dec. 4, 2015; CN201610050944.9 filed Jan. 26, 2016; and CN201610658402.X filed Aug. 11, 2016, each of which is incorporated herein by reference in its entirety.

If (1) a term in the present application conflicts with the term used in a previous application to which the present application claims priority, or (2) conflicts with a term in an application incorporated by reference (2a) into the present application or into (2b) an application to which the present application claims priority, a construction based on the term as used or defined in the present application prevails.

FIELD OF THE INVENTION

The present invention relates to the features of LED incendiaries. More particularly, this invention describes various new and useful improvements for LED tube lamps.

BACKGROUND OF THE INVENTION

LED lighting technology is rapidly developing to replace traditional incandescent and fluorescent lightings. LED tube lamps are mercury-free in comparison with fluorescent tube lamps that need to be filled with inert gas and mercury. Thus, it is not surprising that LED tube lamps are becoming a highly desirable illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption. Therefore, they are considered a cost-effective lighting solution.

Typical LED tube lamps have a variety of LED elements and driving circuits. The LED elements include LED chip-packaging elements, light diffusion elements, high efficient heat dissipating elements, light reflective boards and light diffusing boards. Heat generated by the LED elements and the driving elements is considerable and mainly dominates the illumination intensity such that the heat dissipation needs to be properly disposed to avoid rapid decrease of the luminance and the lifetime of the LED lamps. Problems including power loss, rapid light decay, and short lifetime due to poor heat dissipation are always the key factors in consideration of improving the performance of the LED illuminating system. It is therefore one of the important issues to solve the heat dissipation problem of the LED products.

Nowadays, most of the LED tube lamps use plastic tubes and metallic elements to dissipate heat from the LEDs. The metallic elements are usually exposed to the outside of the plastic tubes. This design improves heat dissipation but heightens the risk of electric shocks. The metallic elements may be disposed inside the plastic tubes. However, heat trapped inside the plastic tubes may cause the plastic tubes to deform. Deformation of the plastic tubes also occurs even when the elements to dissipate heat from the LEDs are not metallic.

The metallic elements disposed to dissipate heat from the LEDs may be made of aluminum. However, aluminum is too soft to sufficiently support the plastic tubes when the deformation of plastic tubes occurs due to the heat as far as the metallic elements disposed inside the plastic tubes are concerned.

A myriad of designs have been contrived to improve the LED tube lamp. Among them are two Chinese patents purported to shape the light coming from the LED light source, to enhance heatsinking efficiency and to facilitate assembly of the LED tube lamp. The Chinese patent CN201320164967.4 filed Apr. 7, 2013 disclosed an aluminum object for LED tube lamps. The aluminum object includes a heatsinking portion, a platform, a left reflective plate and a right reflective plate. At least one reinforcing rib connects the platform and the heatsinking portion, forming an H-shaped structure in the aluminum object. In an embodiment, a pair of reinforcing ribs connect the platform and the heatsinking portion. The pair of reinforcing ribs, perpendicular to the platform, are spaced apart from each other. A screw hole is formed between the pair of reinforcing ribs for fastening the end cap to the lamp tube. Similarly, another Chinese patent CN201010611712.9 filed Dec. 29, 2010 disclosed a light-shaping and heatsinking device for LED tube lamps. The device comprises a base, which includes a pair of flanges at edges of the base for fastening the base to the lamp tube. The base further includes a reinforcing rib in the middle portion of the base. The cross section of the base defines an arc and a chord sitting squarely in the arc. The base further includes a plurality of radiating fins on the outer surface of the base. A platform is formed along the chord for lodging the LED light strip. A reflective plate connects the edge of the base and the platform for guiding the light up to a desired direction. A screw hole is formed between the reinforcing ribs for fastening the end cap to the lamp tube.

The benefits such design bestows upon us are clearly outweighed by the problems arising from it. The LED tube lamps described above include, in common, an aluminum object shaped to do multiple things at the same time regardless of the rest of the lamp tube: shaping the light otherwise aimless straying; providing a mounting base for other parts of the LED tube lamp and providing a heatsink. The aluminum object in the prior art—which is configured to reflect light, dissipate heat and hold the parts together—would have to be bigger, heavier and cost more to make than an aluminum object which is holistically designed to coordinate with other parts of a lamp tube to perform a greater set of functions even better. Moreover, the reflective plate in the prior art, which is meant to bounce light outwards on one side, happens to block light from the other side. Consequently, the LED tube lamp having such reflective plate leaves an eerie swipe of near darkness behind the lamp. Furthermore, fastening the end cap to the lamp tube with a screw and a hole poses security and structural issues. Accidents such as short circuit and electric shock would be more likely, other things equal, when a screw—which is an electrical conductor—is connecting the end cap and the lamp tube than when a non-conductive fastening means is deployed. Additionally, the aluminum object would be more likely to deform under stress when a screw—which by nature is a destructive fastening means—cuts through the object than when a non-destructive fastening means is deployed.

OBJECT AND SUMMARY OF THE INVENTION

Therefore, it is an object of the claimed invention to optimize an LED tube lamp in light of a balanced totality of such considerations as structural integrity, heatsinking efficiency, light shape, field angle, form factor, easy assembly, safety and cost. Instead of encumbering a reinforcing portion with multiple functions as if it were alone in a lamp, the reinforcing portion in the claimed invention is holistically designed in coordination with the rest of the LED tube lamp by quantitatively tweaking such parameters as length, area, curvature, position, opacity, thermal property, stiffness diversity and material diversity. For example, when the light transmissive portion is bigger in relation to the reinforcing portion, other things equal, we get a wider field angle without having to enlarge the reinforcing portion. Alternatively, when the light transmissive portion forms a converging lens in it, light coming from the LED light source is guided by refraction towards a desired direction without the reflective plate getting in the way. It is yet another object of the invention to make the LED tube lamp safer and structurally stabler. For example, the end cap is attached to the reinforcing portion with a non-destructive and non-electrically conductive fastener.

In accordance with an exemplary embodiment of the claimed invention, the LED tube lamp comprises a lamp tube, which includes a light transmissive portion, a reinforcing portion and an end cap; and an LED light assembly, which includes an LED light source and an LED light strip, wherein: the light transmissive portion is fixedly connected to the reinforcing portion; the reinforcing portion includes a platform and a bracing structure; the bracing structure is fixedly connected to the platform and holds the platform in place; the LED light source is thermally and electrically connected to the LED light strip, which is in turn thermally connected to the reinforcing portion; the end cap is attached to an end of the lamp tube; an outer surface of the lamp tube reveals a combination of metallic outer surface and nonmetallic outer surface; a cross section of the lamp tube perpendicular to the lamp tube's longitudinal axis reveals a combination of metallic object and nonmetallic object; a hypothetical line D-D horizontally bisects the cross section into an upper segment and a lower segment; the upper segment and the lower segment have an identical length vertically; a hypothetical line segment U-L vertically bisects the cross section into a left segment and a right segment; the left segment and the right segment have an identical length horizontally; the line segment U-L includes an upper endpoint U and a lower endpoint L, both endpoints falling on a circumference of the cross section; a length of the line segment U-L from the point U to the point L is H; a line T-T is a lowest horizontal line on the cross section above which no metallic object is found; a line B-B is a highest horizontal line on the cross section below which no metallic object is found; a distance from the line T-T to the line B-B is D; a distance from the point U to the line T-T is D1; a distance from the line B-B to the point L is D2; a line T'-T' is a lowest horizontal line on the cross section above which no reinforcing portion is found; a line B'-B' is a highest horizontal line on the cross section below which no reinforcing portion is found; a distance from the line T'-T' to the line B-B is F; a distance from the point U to the line T'-T' is F1; a distance from the line B'-B' to the point L is F2; a hypothetical closed curve is defined on the cross section by all points whose distance from a center of the cross section is half the distance from the center to the circumference of the cross section; the curve divides the cross section into a disk containing the center and a ring surrounding the disk; R1 is a ratio of an overall area of the metallic outer surface to an overall area of the nonmetallic outer surface; and R1 is from 0.001 to 0.9.

In accordance with an exemplary embodiment of the claimed invention, a ratio R2 is defined for the aforesaid LED tube lamp. R2 is a ratio of an overall length of the metallic object that shows itself on the circumference of the cross section to an overall length of the nonmetallic object that shows itself on the circumference of the cross section. R2 is a constant regardless of where the cross section finds itself on the longitudinal axis of the lamp tube. R2 is from 0.02 to 0.9.

In accordance with an exemplary embodiment of the claimed invention, a ratio R3 is defined for the aforesaid LED tube lamp. R3 is a ratio of an overall area of the metallic object on the cross section to an overall area of the nonmetallic object on the cross section. R3 is a constant regardless of where the cross section finds itself on the longitudinal axis of the lamp tube. R3 is from 0.005 to 1.4.

In accordance with an exemplary embodiment of the claimed invention, a ratio R4 is defined for the aforesaid LED tube lamp. R4 is a ratio of the aggregate of the linear distance around the edge of the metallic object on the cross section to the aggregate of the linear distance around the edge of the nonmetallic object on the cross section. R4 is a constant regardless of where the cross section finds itself on the longitudinal axis of the lamp tube. R4 is from 0.05 to 0.45.

In accordance with an exemplary embodiment of the claimed invention, a ratio R5 is defined for the aforesaid LED tube lamp. R5 is a ratio of an overall area of the metallic object found in the upper segment to an overall area of the metallic object found in the lower segment. R5 is a constant regardless of where the cross section finds itself on the longitudinal axis of the lamp tube. R5 is from 0.001 to 0.1.

In accordance with an exemplary embodiment of the claimed invention, a ratio R6 is defined for the aforesaid LED tube lamp. R6 is a ratio of the aggregate of the linear distance around the edge of the metallic object found in upper segment to the aggregate of the linear distance around the edge of the metallic object found in the lower segment. R6 is a constant regardless of where the cross section finds itself on the longitudinal axis of the lamp tube. R6 is from 0.001 to 0.5.

In accordance with an exemplary embodiment of the claimed invention, a ratio R7 is defined for the aforesaid LED tube lamp. R7 is a ratio of an overall area of the metallic object found in the disk to an overall area of the metallic object found in the ring. R7 is a constant regardless of where the cross section finds itself on the longitudinal axis of the lamp tube. R7 is from 0 to 0.1.

In accordance with an exemplary embodiment of the claimed invention, a ratio R8 is defined for the aforesaid LED tube lamp. R8 is a ratio of the aggregate of the linear distance around the edge of the metallic object found in the disk to the aggregate of the linear distance around the edge of the metallic object found in the ring. R8 is a constant regardless of where the cross section finds itself on the longitudinal axis of the lamp tube. R8 is from 0 to 0.05.

In accordance with an exemplary embodiment of the claimed invention, a ratio R9 is defined for the aforesaid LED tube lamp. R9 is D3/H. R9 is a constant regardless of where the cross section finds itself on the longitudinal axis of the lamp tube. R9 is from 0.05 to 0.45.

In accordance with an exemplary embodiment of the claimed invention, a ratio R10 is defined for the aforesaid LED tube lamp. R10 is D1/H. R10 is a constant regardless of where the cross section finds itself on the longitudinal axis of the lamp tube. R10 is from 0.055 to 0.95.

In accordance with an exemplary embodiment of the claimed invention, a ratio R11 is defined for the aforesaid LED tube lamp. R11 is D2/H. R11 is a constant regardless of where the cross section finds itself on the longitudinal axis of the lamp tube. R11 is from 0.01 to 0.45.

In accordance with an exemplary embodiment of the claimed invention, a number E is defined for the aforesaid LED tube lamp. E is a number of types of metal found in the cross section. E is a constant regardless of where the cross section finds itself on the longitudinal axis of the lamp tube. E is from 2 to 10.

In accordance with an exemplary embodiment of the claimed invention, a ratio R12 is defined for the aforesaid LED tube lamp. R12 is a ratio of an overall area of the opaque outer surface to an overall area of the translucent outer surface. R12 is from 0.05 to 0.99.

In accordance with an exemplary embodiment of the claimed invention, a ratio R13 is defined for the aforesaid LED tube lamp. R13 is a ratio of an overall length of the opaque object that shows itself on the circumference of the cross section to an overall length of the translucent object that shows itself on the circumference of the cross section. R13 is a constant regardless of where the cross section finds itself on the longitudinal axis of the lamp tube. R13 is from 0.05 to 0.99.

In accordance with an exemplary embodiment of the claimed invention, a ratio R14 is defined for the aforesaid LED tube lamp. R14 is a ratio of an overall area of the reinforcing portion that shows itself on the outer surface of the lamp tube to an overall area of the light transmissive portion that shows itself on the outer surface of the lamp tube. R14 is from 0.02 to 1.65.

In accordance with an exemplary embodiment of the claimed invention, a ratio R15 is defined for the aforesaid LED tube lamp. R15 is a ratio of an overall length of the reinforcing portion that shows itself on the circumference of the cross section to an overall length of the light transmissive portion that shows itself on the circumference of the cross section. R15 is a constant regardless of where the cross section finds itself on the longitudinal axis of the lamp tube. R15 is from 0.02 to 1.65.

In accordance with an exemplary embodiment of the claimed invention, a ratio R16 is defined for the aforesaid LED tube lamp. R16 is a ratio of an overall area of the reinforcing portion on the cross section to an overall area of the light transmissive portion on the cross section. R16 is a constant regardless of where the cross section finds itself on the longitudinal axis of the lamp tube. R16 is from 0.02 to 4.

In accordance with an exemplary embodiment of the claimed invention, a ratio R17 is defined for the aforesaid LED tube lamp. R17 is a ratio of the aggregate of the linear distance around the edge of the reinforcing portion on the cross section to the aggregate of the linear distance around the edge of the light transmissive portion on the cross section. R17 is a constant regardless of where the cross section finds itself on the longitudinal axis of the lamp tube. R17 is from 0.02 to 1.

In accordance with an exemplary embodiment of the claimed invention, a ratio R18 is defined for the aforesaid LED tube lamp. R18 is F/H. R18 is a constant regardless of where the cross section finds itself on the longitudinal axis of the lamp tube. R18 is from 0.05 to 0.4.

In accordance with an exemplary embodiment of the claimed invention, a ratio R19 is defined for the aforesaid LED tube lamp. R19 is F1/H. R19 is a constant regardless of where the cross section finds itself on the longitudinal axis of the lamp tube. R19 is from 0.6 to 0.95.

In accordance with an exemplary embodiment of the claimed invention, a ratio R13 is defined for the aforesaid LED tube lamp. 21. R20 is F2/H. R20 is a constant regardless of where the cross section finds itself on the longitudinal axis of the lamp tube. R20 is from 0 to 0.45.

In accordance with an exemplary embodiment of the claimed invention, a number G is defined for the aforesaid LED tube lamp. G is a number of groups of materials categorized by stiffness found in the cross section of the lamp tube. G is a constant regardless of where the cross section finds itself on the longitudinal axis of the lamp tube. G is from 5 to 15.

In accordance with an exemplary embodiment of the claimed invention, a ratio R23 is defined for the aforesaid LED tube lamp. R23 is a ratio of an overall area of all objects having greatest stiffness on the cross section to an overall area of all other objects having less stiffness on the cross section. R23 is a constant regardless of where the cross section finds itself on the longitudinal axis of the lamp tube. R23 from 0.005 to 0.1.

In accordance with an exemplary embodiment of the claimed invention, a ratio R24 is defined for the aforesaid LED tube lamp. R24 is a ratio of the aggregate of the linear distance around the edge of all objects having greatest stiffness on the cross section to the aggregate of the linear distance around the edge of all other objects having less stiffness on the cross section. R24 is a constant regardless of where the cross section finds itself on the longitudinal axis of the lamp tube. R24 from 0.005 to 1.65.

In accordance with an exemplary embodiment of the claimed invention, a number K is defined for the aforesaid LED tube lamp. The cross section of the lamp tube perpendicular to the lamp tube's longitudinal axis contains a subset of the cross section revealing one of the reinforcing portion, a ridge, a maintaining stick, a protruding bar and a combination selected from above. The subset of the cross section reveals a combination of objects made of materials having a variety of stiffness. K is a number of groups of the materials categorized by stiffness found in the subset of the cross section of the lamp tube. K is from 5 to 15.

In accordance with an exemplary embodiment of the claimed invention, a ratio R25 is defined for the aforesaid LED tube lamp. R25 is a ratio of an overall area of all objects having greatest stiffness on the subset of the cross section to an overall area of all other objects having less stiffness on the subset of the cross section. R25 is a constant regardless of where the cross section finds itself on the longitudinal axis of the lamp tube. R25 is from 0.02 to 4.

In accordance with an exemplary embodiment of the claimed invention, a ratio R26 is defined for the aforesaid LED tube lamp. R26 is a ratio of the aggregate of the linear distance around the edge of all objects having greatest stiffness on the subset of the cross section to the aggregate of the linear distance around the edge of all other objects having less stiffness on the subset of the cross section. R26 is a constant regardless of where the cross section finds itself on the longitudinal axis of the lamp tube. R26 is from 0.02 to 1.

In accordance with an exemplary embodiment of the claimed invention, numbers P and Q are defined for the aforesaid LED tube lamp. The cross section of the lamp tube perpendicular to the lamp tube's longitudinal axis contains a subset of the cross section revealing one of the reinforcing portion, a ridge, a maintaining stick, a protruding bar and a combination selected from above. The subset of the cross section reveals a combination of metallic objects and plastic objects. P is a number of types of metal found in the subset of the cross section. Q is a number of types of plastic found in subset of the cross section. P is from 2 to 10. Q is from 1 to 5.

In accordance with an exemplary embodiment of the claimed invention, a ratio R27 is defined for the aforesaid LED tube lamp. The cross section of the lamp tube perpendicular to the lamp tube's longitudinal axis contains a subset of the cross section revealing one of the reinforcing portion, a ridge, a maintaining stick, a protruding bar and a combination selected from above. The subset of the cross section reveals a combination of metallic objects and nonmetallic objects. R27 is an overall area of the metallic objects on the subset of the cross section to an overall area of the nonmetallic objects on the subset of the cross section. R27 is a constant regardless of where the cross section finds itself on the longitudinal axis of the lamp tube. R27 from 0 to 0.5.

In accordance with an exemplary embodiment of the claimed invention, the LED tube lamp comprises a lamp tube, which includes a light transmissive portion, a reinforcing portion and an end cap; and an LED light assembly, which includes an LED light source and an LED light strip, wherein: the light transmissive portion is fixedly connected to the reinforcing portion; the reinforcing portion includes a platform and a bracing structure; the bracing structure is fixedly connected to the platform and holds the platform in place; the LED light source is thermally and electrically connected to the LED light strip, which is in turn thermally connected to the reinforcing portion; the end cap is attached to an end of the lamp tube; the outer surface of the lamp tube is exclusively made of plastic; and the outer surface of the lamp tube reveals a combination of thermally conductive plastic and light transmissive plastic.

In accordance with an exemplary embodiment of the claimed invention, a ratio R21 is defined for the aforesaid LED tube lamp. R21 is a ratio of an overall area of the thermally conductive plastic that shows itself on the outer surface of the lamp tube to an overall area of the light transmissive plastic that shows itself on the outer surface of the lamp tube. R21 is from 0.05 to 1.

In accordance with an exemplary embodiment of the claimed invention, a ratio R22 is defined for the aforesaid LED tube lamp. R22 is a ratio of an overall length of the thermally conductive plastic that shows itself on the circumference of the cross section to an overall length of the light transmissive plastic that shows itself on the circumference of the cross section. R22 is a constant regardless of where the cross section finds itself on the longitudinal axis of the lamp tube. R22 is from 0.05 to 1.

In accordance with an exemplary embodiment of the claimed invention, the LED tube lamp comprises a lamp tube and an LED light assembly. The lamp tube includes a light transmissive portion, a reinforcing portion and an end cap. The LED light assembly includes an LED light source and an LED light strip. The reinforcing portion includes a platform and a bracing structure fixedly connected to the platform. The LED light assembly is disposed on an upper surface of the platform. The end cap is attached to an end of the lamp tube. The light transmissive portion and the reinforcing portion define a dividing line between them on a cross section of the lamp tube. The LED light strip includes a first metallic object. The bracing structure includes a second metallic object having a greater stiffness but less heatsinking capability than the first metallic object. The ratio of the volume of the first metallic object to the volume of the second metallic object in the lamp tube is from 0.001:1 to 100:1.

In accordance with an exemplary embodiment of the claimed invention, the end cap in the aforementioned LED tube lamp is attached to the reinforcing portion with a fastener. The fastener is non-electrically conductive.

In accordance with an exemplary embodiment of the claimed invention, the end cap in the aforementioned LED tube lamp is attached to the reinforcing portion with a fastener. The fastener is non-destructive to the end cap and the reinforcing portion.

Various other objects, advantages and features of the present invention will become readily apparent from the ensuing detailed description, and the novel features will be particularly pointed out in the appended claims.

BRIEF DESCRIPTION OF THE DRAWINGS

The following detailed descriptions, given by way of example, and not intended to limit the present invention solely thereto, will be best be understood in conjunction with the accompanying figures.

DETAILED DESCRIPTION OF THE EMBODIMENTS

Figure 1:
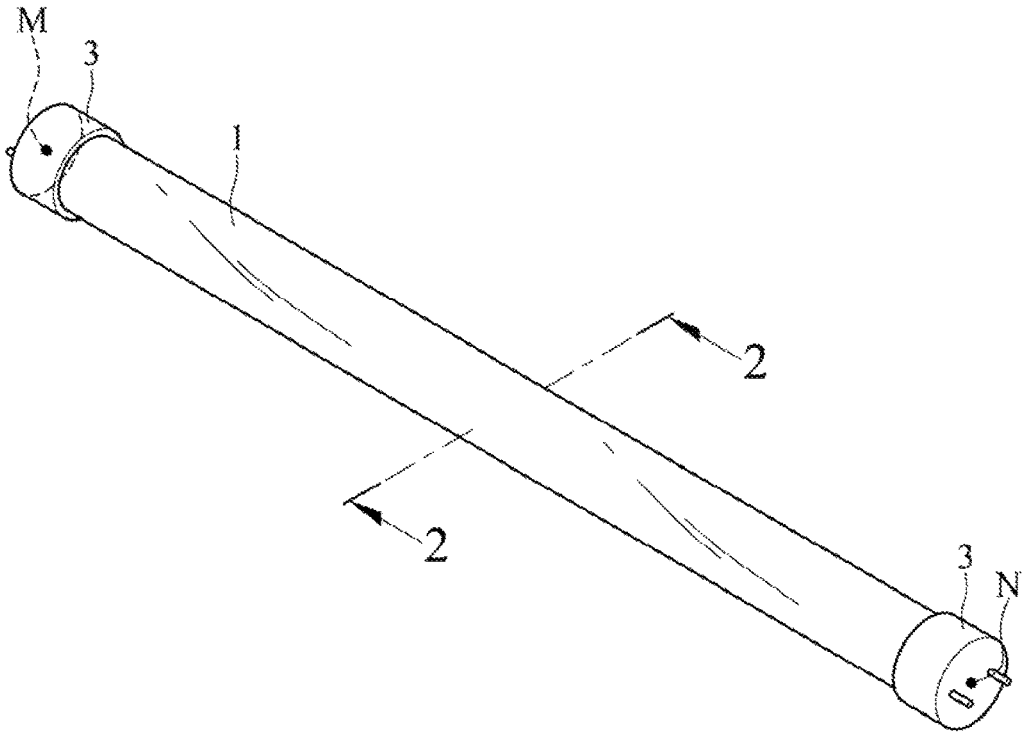
FIG. 1 is a perspective view of the LED tube lamp showing the lamp tube in accordance with an exemplary embodiment of the claimed invention.
Figure 2:
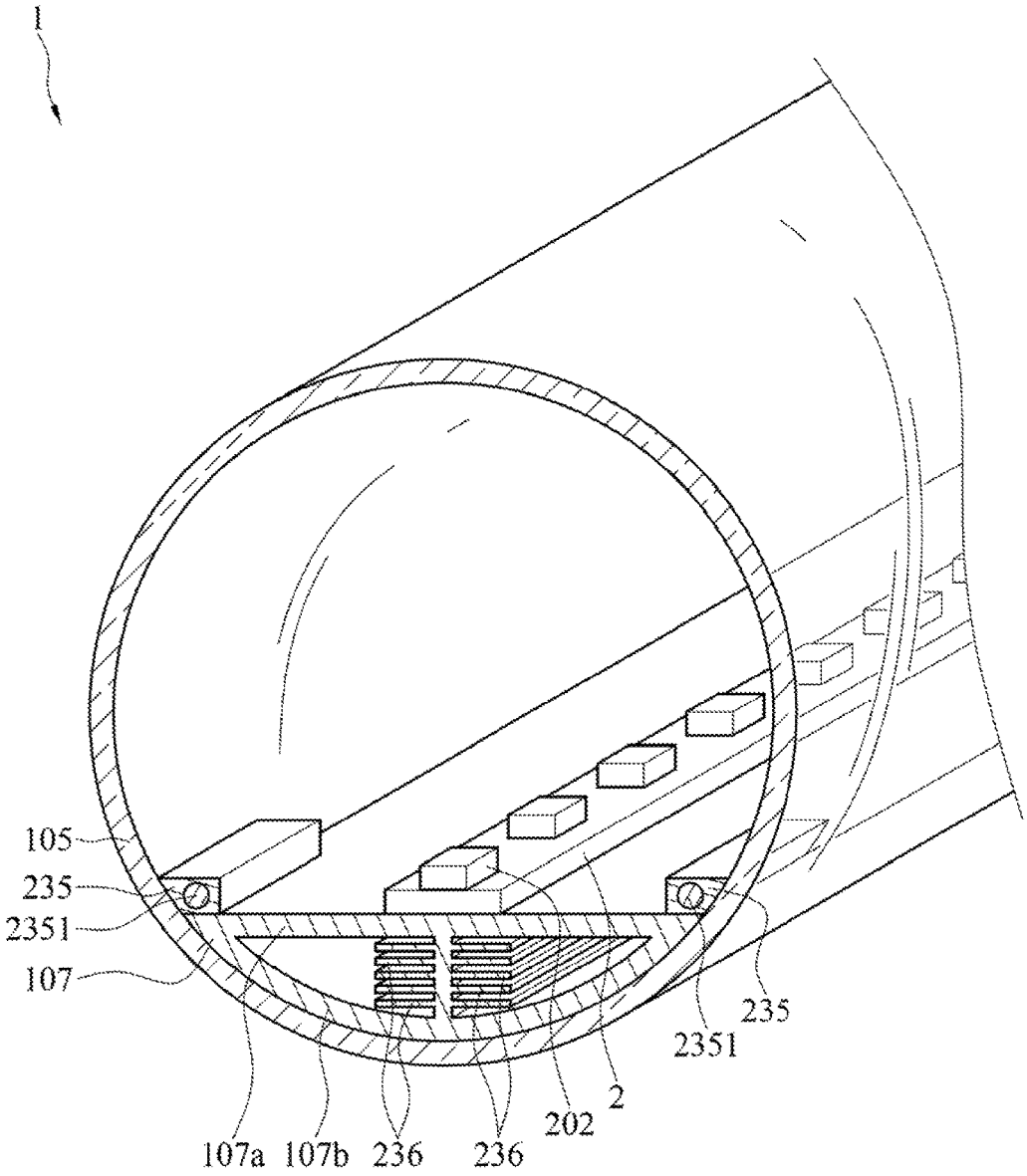
FIG. 2 is a perspective cross-sectional view of the lamp tube in FIG. 1 along 2-2.

Turing to FIGS. 1 and 2, in accordance with an exemplary embodiment of the claimed invention, the LED tube lamp comprises a lamp tube 1 and an LED light assembly. The lamp tube 1 includes a light transmissive portion 105 and a reinforcing portion 107. The reinforcing portion 107 is fixedly connected to the light transmissive portion 105. In accordance with an exemplary embodiment of the claimed invention, the LED tube lamp further comprises an end cap 3, which is fixedly connected to an end of the lamp tube 1.

In an embodiment, the end cap 3 is attached to the reinforcing portion 107 with a fastener. The fastener is either electrically conductive or non-conductive. In some embodiments, the fastener is an electrical conductor such as screw and bolt. In other embodiments, the fastener is non-conductive such as buckle, clip, tape and glue. The fastener is either destructive to the objects to be joined or non-destructive. In some embodiments, the fastener is destructive such as screw and bolt. In other embodiments, the fastener is non-destructive such as buckle, clip, tape and glue.

Typically, the lamp tube 1 has a shape of an elongated cylinder, which is a straight structure. However, the lamp tube 1 can take any curved structure such as a ring or a horseshoe. A cross section of the lamp tube 1 defines, typically, a circle, or not as typically, an ellipse or a polygon. Alternatively, a cross section of the lamp tube 1 takes an irregular shape depending on the shapes of, respectively, the light transmissive portion 105 and the reinforcing portion 107 and on the manner the two portions 105, 107 interconnect to form the lamp tube 1. An outer surface of a lamp tube 1 includes a side surface around a longitudinal axis M-N of the lamp tube 1 and two parallel end surfaces. The longitudinal axis M-N has endpoints M, N that fall exactly on the end surfaces. When the lamp tube 1 has a shape of a circular cylinder, the side surface defines an open cylinder around the longitudinal axis M-N and the end surface defines a circle. The longitudinal axis M-N has endpoints M, N sitting exactly at the center of the circle.

In accordance with an exemplary embodiment of the claimed invention, the reinforcing portion 107 includes a platform 107*a* and a bracing structure 107*b*. The platform 107*a* has an upper surface and a lower surface. The LED light assembly is disposed on the upper surface of the platform 107*a*. The bracing structure 107*b* is fixedly connected to the platform 107*a* and holds the platform 107*a* in place. The bracing structure 107*b* includes a horizontal rib, a vertical rib, a curvilinear rib or a combination of ribs selected from the above. The dimensions of the platform 107*a*, the horizontal rib and the vertical rib, their quantities and the manner they interconnect depend on a desired totality of considerations such as heat dissipation efficiency and structural strength. In some embodiments, a rib of the bracing structure is fixedly connected at both ends to an end of another rib, to the platform or to a point on the lamp tube. In other embodiments, a first end of a rib of the bracing structure is fixedly connected to an end of another rib, to the platform or to a point on the lamp tube but a second end of the rib is in the air.

The LED light assembly is disposed inside the lamp tube 1 and includes an LED light source 202 and an LED light strip 2. The LED light source 202 is thermally and electrically connected to the LED light strip 2, which is in turn thermally connected to the reinforcing portion 107. Heat generated by the LED light source 202 is first transmitted to the LED light strip 2 and then to the reinforcing portion 107 before egressing the lamp tube 1. In some embodiments, the LED light strip is substituted for the platform. Thus, the bracing structure is fixedly connected to the LED light strip and holds the LED light strip in place.

In accordance with an exemplary embodiment of the claimed invention, the lamp tube 1 further includes a protruding part 236. In some embodiments, a plurality of protruding parts 236 are disposed on a surface of the reinforcing portion 107. In other embodiments, a plurality of protruding parts 236 are disposed on the surface of the LED light strip 2 that is not covered by the LED light assembly. Like fins on a heatsink, the protruding part 236 boosts heat dissipation by increasing the surface area of the reinforcing portion 107 and the LED light strip 2. The protruding parts 236 are disposed equidistantly, or alternatively, not equidistantly. A first end of a protruding part 236 is fixedly connected to the lamp tube 1; a second end of the protruding part 236 is either connected to the lamp tube 1 or in the air.

In accordance with an exemplary embodiment of the claimed invention, the lamp tube 1 further includes a ridge 235. The ridge 235 extends in an axial direction along an inner surface of the lamp tube 1. The ridge 235 is either a hollow structure defining a space inside the ridge or a solid structure. The ridge 235 is an elongated structure unbroken from end to end, or alternatively, broken at intervals.

In accordance with an exemplary embodiment of the claimed invention, the lamp tube further includes maintaining stick 2351. The maintaining stick 2351 is, likewise, an elongated structure, which is unbroken from end to end, or alternatively, broken at intervals, and which fills up the space inside the ridge 235 when the ridge is a hollow structure.

In accordance with an exemplary embodiment of the claimed invention, the outer surface of the lamp tube 1 reveals a combination of metallic object that shows itself on a metallic outer surface and nonmetallic object that shows itself on a nonmetallic outer surface. In an embodiment, a nonmetallic object forms all of the outer surface of the lamp tube 1 and no metallic object forms any of the outer surface of the lamp tube 1. In other words, all of the outer surface of the lamp tube 1 is a nonmetallic outer surface. In another embodiment, a metallic object forms a metallic outer surface of the lamp tube 1 and a nonmetallic object forms a nonmetallic outer surface of the lamp tube 1. The metallic outer surface is found in one of the reinforcing portion 107, the light transmissive portion 105, the LED light assembly, the end cap 3, the ridge 235, the maintaining stick 2351, the protruding bar 236 and a combination selected from the above. The metallic outer surface is made of one of pure metal, metal alloy and a combination selected from the above. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. Likewise, the nonmetallic outer surface is found in one of the reinforcing portion 107, the light transmissive portion 105, the LED light assembly, the end cap 3, the ridge 235, the maintaining stick 2351, the protruding bar 236 and a combination selected from the above. The reinforcing portion 107 that forms the outer surface of the lamp tube 1 is either the platform 107*a*, the bracing structure 107*b* or both. The bracing structure 107*b* that forms the outer surface of the lamp tube 1 is either the vertical rib, the horizontal rib, the curvilinear rib or a combination selected from the above. The LED light assembly that forms the outer surface of the lamp tube 1 is either the LED light source 202, the LED light strip 2 or both. The LED light strip 2 that forms the outer surface of the lamp tube 1 is either an electronic component, a conductive track, a conductive pad, a via, a substrate or a combination selected from the above. The nonmetallic outer surface is made of one of glass, plastic, rubber and a combination selected from the above. In some embodiments, a metallic outer surface and a nonmetallic outer surface are found in a same structure, e.g. a reinforcing portion 107 or an end cap 3. In other embodiments, either a metallic outer surface or a nonmetallic outer surface but not both is found in a structure that forms an outer surface of the lamp tube. For example, the reinforcing portion 107 that forms the outer surface of the lamp tube 1 is exclusively metallic but the light transmissive portion 105 that forms the outer surface of the lamp tube 1 is exclusively plastic. The ratio R1 of the overall area of the metallic outer surface to the overall area of the nonmetallic outer surface depends on a desired totality of considerations that we want from a lamp tube such as structural strength, thermal conductivity and luminous output. Other things equal, the greater R1 is, the LED tube lamp is configured to dissipate heat more efficiently due to a greater contact by the metallic outer surface with ambient air but potentially compromise luminous output because the metallic outer surface blocks light coming from within the lamp tube 1. Preferably, R1 is from 0.001 to 0.9.

Figure 3:
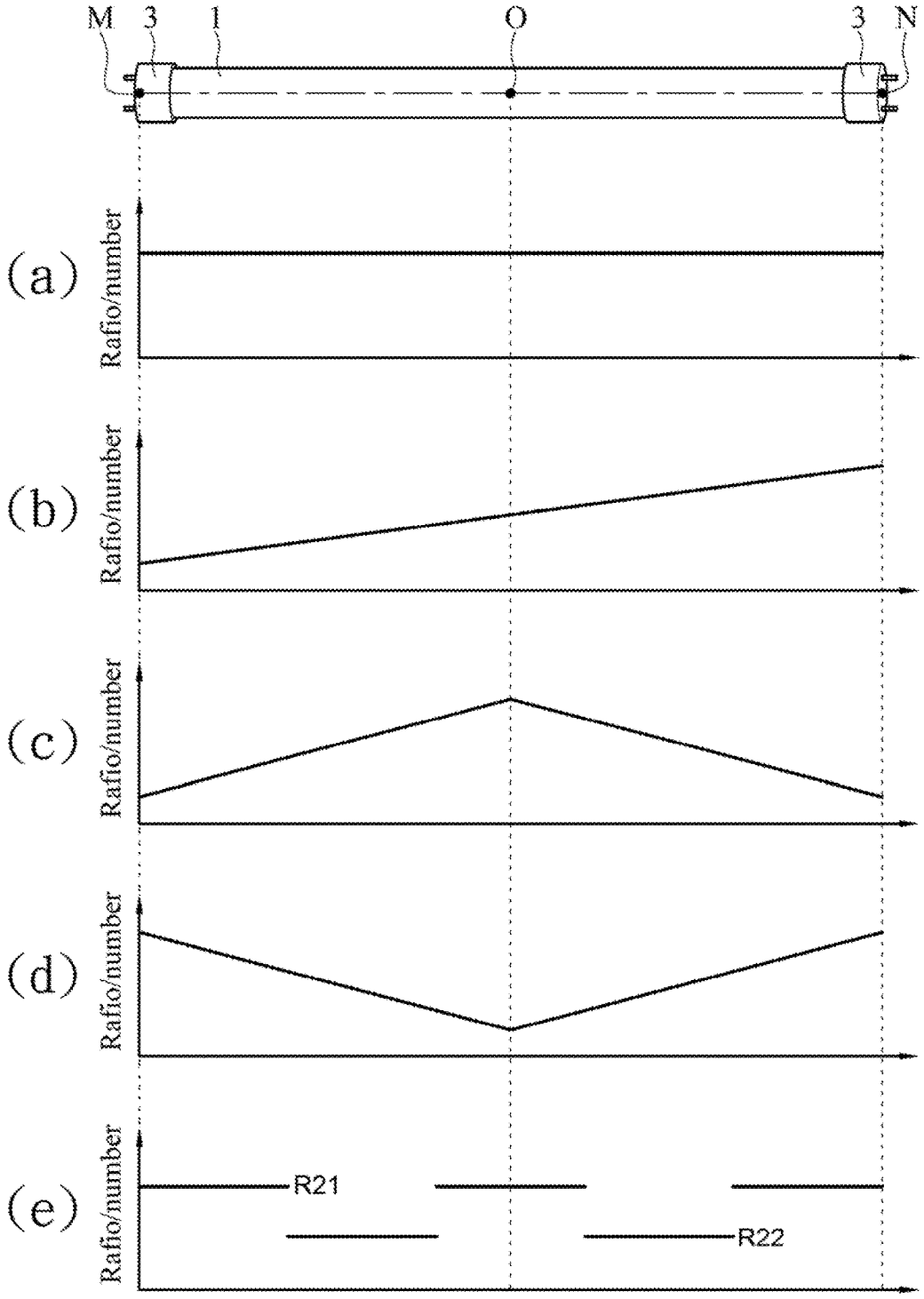
FIGS. 3(*a*)-(*e*) diagram the variations of the ratios or numbers defined infra along the longitudinal axis M-N of the lamp tube in FIG. 1.
Figure 4:
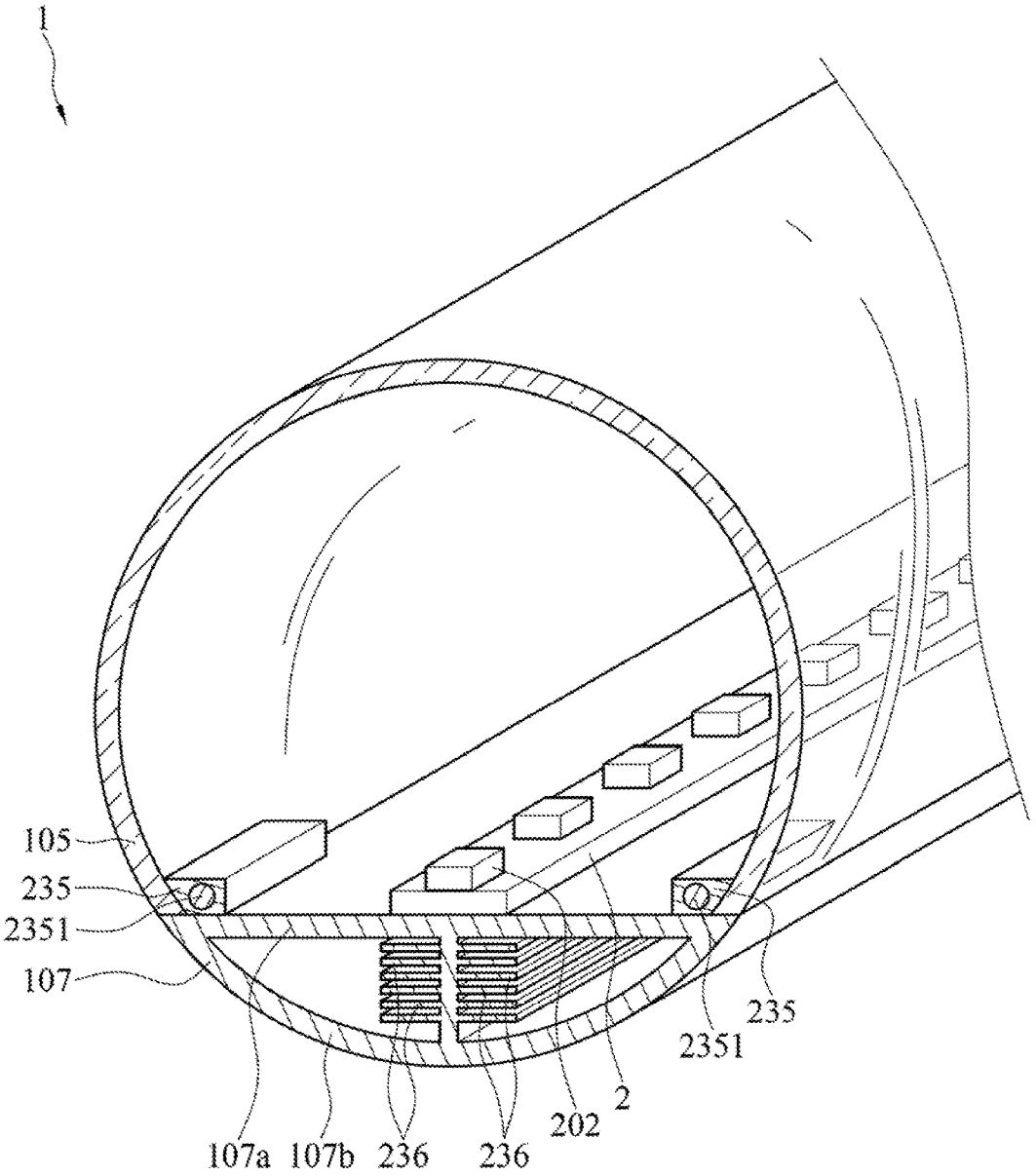
FIG. 4 is a perspective cross-sectional view of the lamp tube in FIG. 1 along 2-2.

Referring to FIG. 4, in accordance with an exemplary embodiment of the claimed invention, the circumference of a cross section of a lamp tube 1 reveals a combination of metallic object and nonmetallic object. In an embodiment, the ratio R2 of the overall length of the metallic object that shows itself on the circumference of a cross section to the overall length of the nonmetallic object that shows itself on the circumference of the cross section is a constant wherever the cross section finds itself on the longitudinal axis M-N of the lamp tube 1 (FIG. 3*a*). Preferably, R2 is from 0.02 to 0.9. Alternatively, R2 is a variable depending on where a cross section finds itself on the longitudinal axis M-N of the lamp tube 1. Where the lamp tube 1 is a straight tubular structure, a hypothetical line segment M-N is defined horizontally along the longitudinal axis of the lamp tube. The endpoint M sits at the leftmost end of the lamp tube 1. The endpoint N sits at the rightmost end of the lamp tube 1. The middle point O bisects the line segment M-N into two equal halves. In an embodiment, R2 goes up from the point M before reaching a climax at the point N (FIG. 3*b*). The LED tube lamp is thus configured to show a greater luminous output toward its left end but greater heat dissipation efficiency toward its right end. Preferably, R2 starts from 0.02 and culminates when it goes up to 1. In another embodiment, R2 goes up from both ways from the point M and the point N before reaching a common climax at the point O (FIG. 3*c*). The LED tube lamp is thus configured to show greater luminous output toward both ends but greater heat dissipation efficiency toward the middle. Preferably, R2 starts from 0.02 and culminates when it goes up to 0.9. In yet another embodiment, R2, starting from the point O, goes up both ways before coming to a climax, respectively, at the point M and at the point N (FIG. 3*d*). The LED tube lamp is thus configured to show greater luminous output toward the middle but greater heat dissipation efficiency toward both ends. Preferably, R2 starts from 0.02 and culminates when it goes up to 0.9. In still another embodiment, a limited combination of ratios applies to successive sets of cross sections (FIG. 3*e*). For example, a first set of cross sections and a second set of cross sections alternate throughout the line segment M-N. A ratio R21 applies to the first set of cross sections and a ratio R22 applies to the second set of cross sections, where R21 is greater than R22. Preferably, R21 is from 0.2 to 0.4 and R22 is from 0.02 to 0.9.

Referring to FIG. 4, in accordance with an exemplary embodiment of the claimed invention, a cross section of the lamp tube 1 perpendicular to the lamp tube's longitudinal axis M-N reveals a combination of metallic object and nonmetallic object. The metallic object is found in one of the reinforcing portion 107, the light transmissive portion 105, the LED light assembly, the end cap 3, the ridge 235, the maintaining stick 2351, the protruding bar 236 and a combination selected from the above. The metallic object is made of one of pure metal, metal alloy and a combination selected from the above. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. Likewise, the nonmetallic object is found in one of the reinforcing portion 107, the light transmissive portion 105, the LED light assembly, the end cap 3, the ridge 235, the maintaining stick 2351, the protruding bar 236 and a combination selected from the above. The reinforcing portion 107 that shows itself on the cross section of the lamp tube 1 is either the platform 107*a*, the bracing structure 107*b* or both. The bracing structure 107*b* that shows itself on the cross section of the lamp tube 1 is either the vertical rib, the horizontal rib, the curvilinear rib or a combination selected from the above. The LED light assembly that shows itself on the cross section of the lamp tube 1 is either the LED light source 202, the LED light strip 2 or both. The LED light strip 2 that is found on the cross section of the lamp tube 1 is either an electronic component, a conductive track, a conductive pad, a via, a substrate or a combination selected from the above. The nonmetallic object is made from one of glass, plastic, rubber and a combination selected from the above. In some embodiments, a metallic object and a nonmetallic object surface are found in a same structure, e.g. the reinforcing portion 107 or the end cap 3. In other embodiments, either a metallic object or a nonmetallic object but not both is found in a same structure that shows itself on a cross section of the lamp tube 1. For example, the reinforcing portion 107 that that is found on the cross section of the lamp tube 1 is exclusively metallic but the light transmissive portion 105 that is found on the same cross section of the lamp tube 1 is exclusively plastic. The ratio R3 of the overall area of the metallic object on a cross section to the overall area of the nonmetallic object on the cross section depends on a desired totality of factors such as structural strength, thermal conductivity and luminous output. Other things equal, the greater R3 is, the LED tube lamp is configured to exhibit greater structural strength, thermal conductivity or both but potentially compromise luminous output because the metallic object is more likely to block light coming from within the lamp tube 1. Preferably, R3 is from 0.005 to 0.1. Likewise, the ratio R4 of the aggregate of the linear distance around the edge of the metallic object on the cross section to the aggregate of the linear distance around the edge of the nonmetallic object on the same cross section depends on a desired totality of factors such as structural strength, thermal conductivity and luminous output. Other things equal, the greater R4 is, the LED tube lamp is configured to exhibit greater structural strength, thermal conductivity or both but potentially compromise luminous output because the metallic object is more likely to block light coming from within the lamp tube 1. Preferably, R4 is from 0.05 to 0.45.

The ratios articulated in the preceding paragraph R3, R4 are either constant on each cross section throughout the longitudinal axis M-N of the lamp tube 1 or variable depending on where a cross section finds itself on the longitudinal axis M-N. In an embodiment, R3 (or R4) is a constant regardless of where a cross section finds itself on the longitudinal axis M-N of the lamp tube 1 (FIG. 3*a*). Preferably, R3 is from 0.005 to 0.1. Preferably, R4 is from 0.05 to 0.45. In another embodiment, R3 (or R4) is variable depending on the location of the cross section on the longitudinal axis M-N. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R3 (or R4) goes up from the point M before reaching a climax at the point N (FIG. 3*b*). The LED tube lamp is thus configured to show greater heat dissipation efficiency, structural strength or both toward the right end. Preferably, R3 starts from 0.005 and culminates when it goes up to 0.1. Preferably, R4 starts from 0.05 and culminates when it goes up to 0.45. In another embodiment, R3 (or R4) goes up from both ways from the point M and the point N before reaching a common climax at the point O (FIG. 3*c*). The LED tube lamp is thus configured to show greater heat dissipation efficiency, structural strength or both toward the middle but greater luminous output toward both ends. Preferably, R3 starts from 0.1 and culminates when it goes up to 0.005. Preferably, R4 starts from 0.45 and culminates when it goes up to 0.05. In yet another embodiment, R3 (or R4), starting from the point O, goes up both ways before coming to a climax, respectively, at the point M and at the point N (FIG. 3*d*). The LED tube lamp is thus configured to show greater luminous output toward the middle but greater heat dissipation efficiency, structural or both toward both ends. Preferably, R3 starts from 0.005 and culminates when it goes up to 0.1. Preferably, R4 starts from 0.05 and culminates when it goes up to 0.45. In still another embodiment, a limited combination of ratios applies to successive sets of cross sections (FIG. 3*e*). For example, a first set of cross sections and a second set of cross sections alternate throughout the line segment M-N. A ratio R31 (or R41) applies to the first set of cross sections and a ratio R32 (or R42) applies to the second set of cross sections.

A cross section of the lamp tube 1 perpendicular to its longitudinal axis M-N also reveals a spatial distribution, observable from various perspectives, of the metallic object on a cross section in relation to the nonmetallic object on the cross section. Tuning to FIG. 5, a hypothetical line D-D horizontally bisects a cross section of the lamp tube 1 into an upper segment and a lower segment. Both of the segments have an identical length vertically. Where the lamp tube 1 takes the shape of a circular cylinder, the cross section of the lamp tube 1 defines a hypothetical circle. Thus, the line D-D divides the circle into an upper circular segment and a lower circular segment. The ratio R5 of the overall area of the metallic object found in the upper segment to the overall area of the metallic object found in the lower segment depends on a desired totality of factors such as structural strength, thermal conductivity and luminous output. Other things equal, the less R5 is, the LED tube lamp—when, for example, its light is directed upwards—is configured to produce a greater luminous output because less light is blocked by the metallic object found in the upper cylindrical segment of the lamp tube 1. Preferably, R5 is from 0 to 0.1. Likewise, the ratio R6 of the aggregate of the linear distance around the edge of the metallic object found in upper segment to the aggregate of the linear distance around the edge of the metallic object found in the lower segment depends on a desired totality of considerations such as structural strength, thermal conductivity and luminous output. Other things equal, the less R6 is, the LED tube lamp—when, for example, its light is directed upwards—is configured to produce greater luminous output because less light is blocked by the metallic object found in the upper cylindrical segment of lamp tube 1. Preferably, R6 is from 0 to 0.5.

The ratios articulated in the preceding paragraph R5, R6 are either constant on each cross section across the longitudinal axis M-N of a lamp tube 1 or variable depending on where a cross section finds itself on the longitudinal axis M-N. In an embodiment, the ratio R5 (or R6) is a constant regardless of where a cross section finds itself on the longitudinal axis M-N of the lamp tube 1 (FIG. 3*a*). Preferably, R5 is from 0 to 0.1. Preferably, R6 is from 0 to 0.5. In another embodiment, R5 (or R6) is a variable depending on the location of the cross section on the longitudinal axis M-N. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R5 (or R6) goes up from the point M before reaching a climax at the point N (FIG. 3*b*). The LED tube lamp is thus configured to show greater luminous output toward the left end but greater heat dissipation efficiency, structural strength or both toward the right end. Preferably, R5 starts from 0 and culminates when it goes up to 0.1. Preferably, R6 starts from 0 and culminates when it goes up to 0.5. In another embodiment, R5 (or R6) goes up from both ways from the point M and the point N before reaching a common climax at the point O (FIG. 3*c*). The LED tube lamp is thus configured to show greater heat dissipation efficiency, structural strength or both toward the middle but greater luminous output toward both ends. Preferably, R5 starts from 0 and culminates when it goes up to 0.1. Preferably, R6 starts from 0 and culminates when it goes up to 0.5. In yet another embodiment, R5 (or R6), starting from the point O, goes up both ways before coming to a climax, respectively, at the point M and at the point N (FIG. 3*d*). The LED tube lamp is thus configured to show greater luminous output toward the middle but greater heat dissipation efficiency, structural strength or both toward both ends. Preferably, R5 starts from 0.1 and culminates when it goes up to 0. Preferably, R6 starts from 0.5 and culminates when it goes up to 0. In still another embodiment, a limited combination of ratios applies to successive sets of cross sections (FIG. 3*e*). For example, a first set of cross sections and a second set of cross sections alternate throughout the line segment M-N. A ratio R51 (or R61) applies to the first set of cross sections and a ratio R52 (or R62) applies to the second set of cross sections, where R51 (or R61) is greater than R52 (or R62).

The spatial distribution described above is observable from another perspective. Turing to FIG. 5, in an embodiment, a hypothetical closed curve C is defined on a cross section of the lamp tube 1 by all points whose distance from the center of the cross section is half the distance from the center to the circumference of the cross section. The curve C divides the cross section into a disk containing the center and a ring surrounding the disk. Where the lamp tube 1 takes the shape of a circular cylinder, the cross section of the lamp tube 1 defines a hypothetical circle. Thus, the curve C divides the circle into a circular disk having a same center as the circle and a radius exactly half of that of the circle; and a circular ring surrounding the disk. The ratio R7 of the overall area of the metallic object found in the disk to the overall area of the metallic object found in the ring depends on a desired totality of factors such as structural strength, thermal conductivity and luminous output. Other things equal, the less R7 is, the LED tube lamp is configured to exhibit greater heat dissipation efficiency because more heat is taken away from the center of lamp tube 1 by the metallic object close to the outer shell of the lamp tube 1. Preferably, R7 is from 0 to 0.1. Likewise, the ratio R8 of the aggregate of the linear distance around the edge of the metallic object found in the disk to the aggregate of the linear distance around the edge of the metallic object found in the ring depends on a desired totality of factors such as structural strength, thermal conductivity and luminous output. Other things equal, the greater R8 is, the LED tube lamp is configured to produce greater luminous output because light coming from the LED light source is less likely to be blocked by the metallic object close to the outer shell of the lamp tube 1. Preferably, R8 is from 0 to 0.05.

The ratios articulated in the preceding paragraph R7, R8 are either constant on each cross section across the longitudinal axis M-N of the lamp tube 1 or variable depending on where a cross section finds itself on the longitudinal axis. In an embodiment, R7 (or R8) is a constant regardless of where a cross section finds itself on the longitudinal axis M-N of the lamp tube 1 (FIG. 3*a*). Preferably, R7 is from 0 to 0.1. Preferably, R8 is from 0 to 0.05. In another embodiment, R7 (or R8) is a variable depending on the location of the cross section on the longitudinal axis M-N. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R7 (or R8) goes up from the point M before reaching a climax at the point N (FIG. 3*b*). The LED tube lamp is thus configured to show greater luminous output toward the left end but greater heat dissipation efficiency, structural strength or both toward the right end. Preferably, R7 starts from 0 and culminates when it goes up to 0.1. Preferably, R8 starts from 0 and culminates when it goes up to 0.05. In another embodiment, R7 (or R8) goes up from both ways from the point M and the point N before reaching a common climax at the point O (FIG. 3*c*). The LED tube lamp is thus configured to show greater luminous output toward both ends but greater heat dissipation efficiency, structural strength or both toward the middle. Preferably, R7 starts from 0 and culminates when it goes up to 0.1. Preferably, R8 starts from 0 and culminates when it goes up to 0.05. In yet another embodiment, R7 (or R8), starting from the point O, goes up both ways before coming to a climax, respectively, at the point M and at the point N (FIG. 3*d*). The LED tube lamp is thus configured to show greater luminous output toward the middle but greater heat dissipation efficiency, structural strength or both toward both ends. Preferably, R7 starts from 0.1 and culminates when it goes up to 0. Preferably, R8 starts from 0.05 and culminates when it goes up to 0. In still another embodiment, a limited combination of ratios applies to successive sets of cross sections (FIG. 3*e*). For example, a first set of cross sections and a second set of cross sections alternate throughout the line segment M-N. A ratio R71 (or R81) applies to the first set of cross sections and a ratio R72 (or R82) applies to the second set of cross sections, where R71 (or R82) is greater than R72 (or R82).

Figure 5:
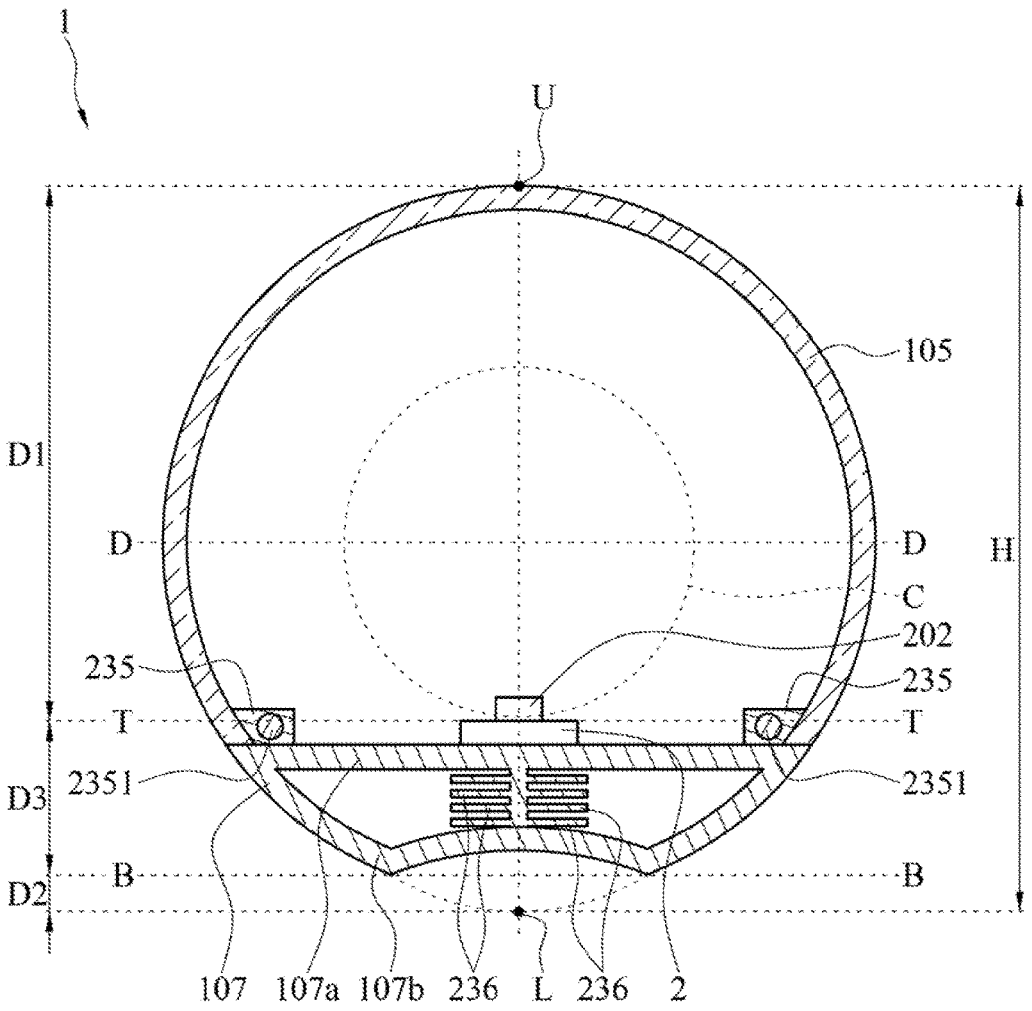
FIG. 5 is a cross-sectional view of the lamp tube in FIG. 1 along 2-2.

The spatial distribution described above is observable from yet another perspective. Turning to FIG. 5, in an embodiment, a hypothetical line segment U-L vertically bisects a cross section of the lamp tube 1 into two segments having an identical length horizontally. The line segment U-L includes an upper endpoint U and a lower endpoint L, both endpoints falling on the circumference of the cross section. Where the lamp tube 1 takes the shape of a circular cylinder, the cross section of the lamp tube 1 defines a hypothetical circle. The line segment U-L vertically bisects the circle along the diameter into two equal halves. The length of the line segment U-L from the point U to the point L, i.e. the diameter of the circle, is H. The line T-T is the lowest horizontal line on the cross section above which no metallic object is found. The line B-B is the highest horizontal line on the cross section below which no metallic object is found. The distance from the line T-T to the line B-B is D3. The distance from the point U to the line T-T is D1. The distance from the point L to the line B-B is D2. Respective ratios R9 (D3/H), R10 (D1/H), R11 (D2/H) depend on a desired totality of advantages that an LED tube lamp is expected to have including structural strength, thermal conductivity and luminous output. Other things equal, the greater R9 or R11 is, the LED tube lamp is configured to exhibit greater heat dissipation efficiency because more heat is taken away from the center of lamp tube 1 but potentially compromise luminous output. Preferably, R9 is from 0.05 to 0.45. Preferably, R11 is from 0.01 to 0.45. Other things equal, the greater R10 is, the LED tube lamp is configured to shed light across a wider angle because the light transmissive portion 105 is generally bigger. Preferably, R10 is from 0.55 to 0.95.

The ratios articulated in the preceding paragraph R9, R10, R11 are either constant on each cross section across the longitudinal axis M-N of the lamp tube 1 or variable depending on where a cross section finds itself on the longitudinal axis M-N. In an embodiment, R9 (or R10, R11) is a constant regardless of where a cross section finds itself on the longitudinal axis M-N of the lamp tube 1 (FIG. 3*a*). Preferably, R9 is from 0.05 to 0.45. Preferably, R10 is from 0.055 to 0.95. Preferably, R11 is from 0.01 to 0.45. In another embodiment, R9 (or R10, R11) is a variable depending on the location of the cross section on the longitudinal axis M-N. Where the lamp tube 1 is a straight tubular structure, a hypothetical line segment M-N is defined horizontally along the longitudinal axis of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R9 (or R10, R11 goes up from the point M before reaching a climax at the point N (FIG. 3*b*). When the ratio refers to R9, the LED tube lamp is thus configured to show greater luminous output toward the left end but greater heat dissipation efficiency toward the right end. When the ratio refers to R10 or R11, the LED tube lamp is thus configured to show greater luminous output toward the right end but greater heat dissipation efficiency toward the left end. Preferably, R9 starts from 0.05 and culminates when it goes up to 0.45. Preferably, R10 starts from 0.55 and culminates when it goes up to 0.95. Preferably, R11 starts from 0.01 and culminates when it goes up to 0.45. In another embodiment, R9 (or R10, R11) goes up from both ways from the point M and the point N before reaching a common climax at the point M (FIG. 3*c*). When the ratio refers to R9, the LED tube lamp is thus configured to show greater luminous output toward both ends but greater heat dissipation efficiency toward the middle. When the ratio refers to R10 or R11, the LED tube lamp is thus configured to show greater luminous output toward the middle but greater heat dissipation efficiency toward the both ends. Preferably, R9 starts from 0.05 and culminates when it goes up to 0.45. Preferably, R10 starts from 0.55 and culminates when it goes up to 0.95. Preferably, R11 starts from 0.01 and culminates when it goes up to 0.45. In yet another embodiment, R9 (or R10, R11), starting from the point O, goes up both ways before coming to a climax, respectively, at the point M and at the point N (FIG. 3*d*). When the ratio refers to R9, the LED tube lamp is thus configured to show greater luminous output toward the middle but greater heat dissipation efficiency toward both ends. When the ratio refers to R10 or R11, the LED tube lamp is thus configured to show greater luminous output toward both ends but greater heat dissipation efficiency toward the middle. Preferably, R9 starts from 0.45 and culminates when it goes up to 0.05. Preferably, R10 starts from 0.95 and culminates when it goes up to 0.55. Preferably, R11 starts from 0.45 and culminates when it goes up to 0.01. In still another embodiment, a limited combination of ratios applies to successive sets of cross sections (FIG. 3*e*). For example, a first set of cross sections and a second set of cross sections alternate throughout the line segment M-N. A ratio R91 (or R101, R111) applies to the first set of cross sections and a ratio R92 (or R102, R112) applies to the second set of cross sections, where R91 (or R101, R111) is greater than R92 (or R102, R112).

Figure 7:
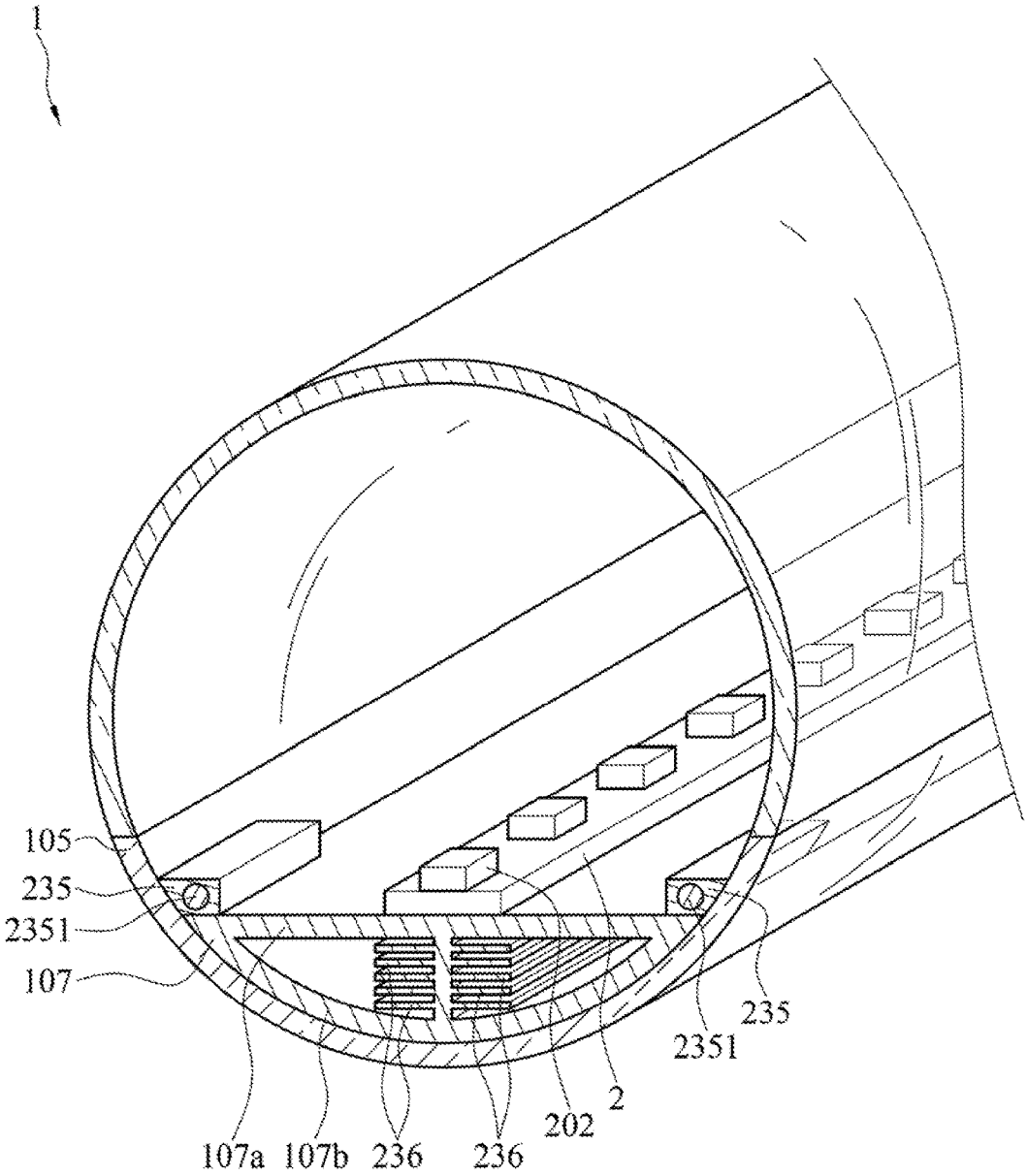
FIG. 7 is a perspective cross-sectional view of the lamp tube in FIG. 1 along 2-2.
Figure 8:
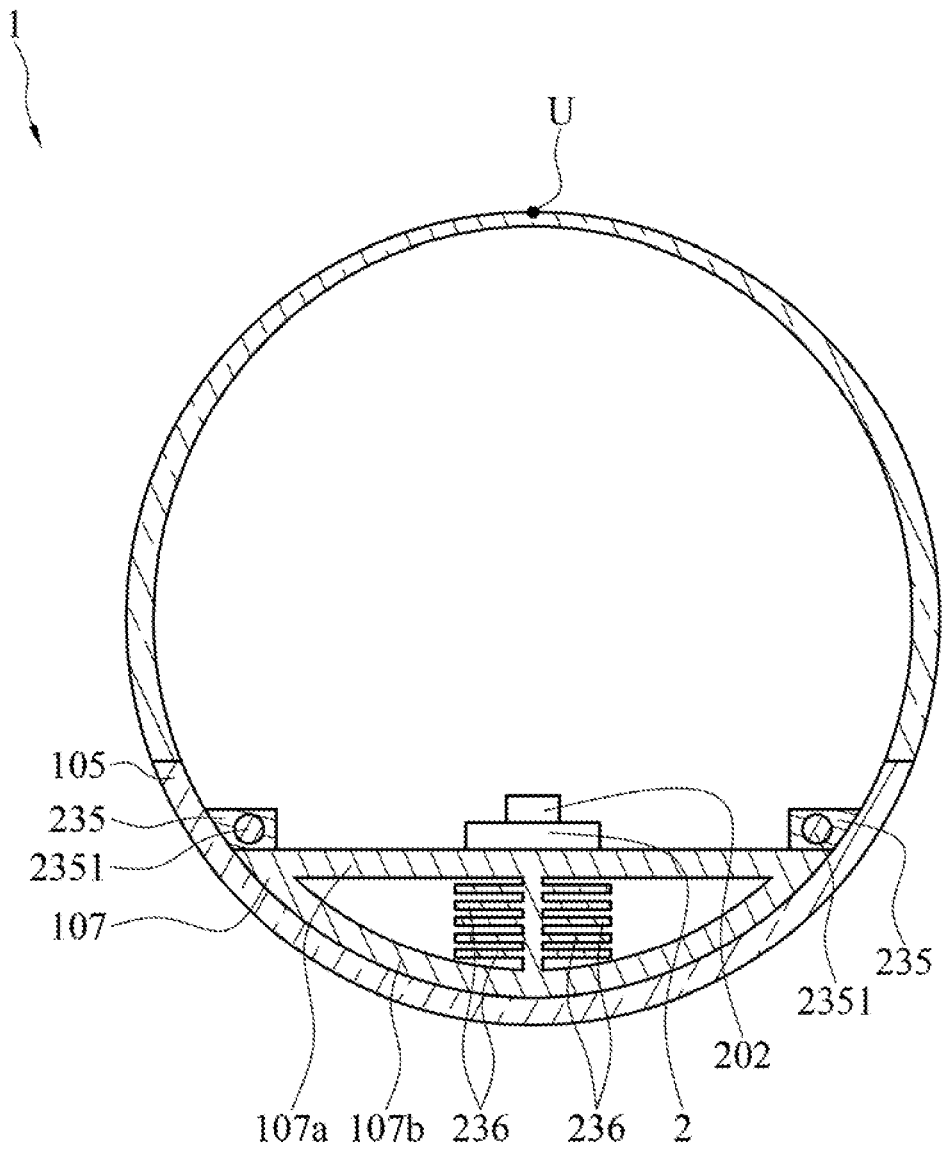
FIG. 8 is a cross-sectional view of the lamp tube in FIG. 1 along 2-2.

Turing to FIG. 7, a cross section of the lamp tube 1 perpendicular to its longitudinal axis M-N reveals either no metallic object at all or at least one metallic object made of one or more types of metal. The metallic object is found in one of the reinforcing portion 107, the light transmissive portion 105, the LED light assembly, the end cap 3, the ridge 235, the maintaining stick 2351, the protruding bar 236 and a combination selected from the above. The metallic object is made of one of pure metal, metal alloy and a combination selected from the above. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. The number of types of metal found in a cross section of a lamp tube 1 is E. In an embodiment, the cross section reveals no metal at all and E equals zero. In another embodiment, the cross section reveals exactly one type of metal and E equals one. In yet another embodiment, the cross section reveals a plurality of types of metal. Preferably, E is an integer from 2 to 10.

The integer E articulated in the preceding paragraph is either constant on each cross section throughout the longitudinal axis M-N of the lamp tube 1 or variable depending on where a cross section finds itself on the longitudinal axis M-N. In an embodiment, E is a constant regardless of where a cross section finds itself on the longitudinal axis M-N of the lamp tube 1 (FIG. 3*a*). Preferably, E is an integer from 2 to 10. In another embodiment, E is a variable depending on the location of the cross section on the longitudinal axis M-N. Where the lamp tube 1 is a straight tubular structure, a hypothetical line segment M-N is defined horizontally along the longitudinal axis of the lamp tube 1. The endpoint M sits at the leftmost end of the lamp tube 1. The endpoint N sits at the rightmost end of the lamp tube 1. The middle point O bisects the line segment M-N into two equal halves. In an embodiment, E goes up from the point M until reaching a climax at the point N (FIG. 3*b*). In another embodiment, E goes up from both ways from the point M and from the point N before reaching a climax at the point O (FIG. 3*c*). In yet another embodiment, E goes up both ways from the point O until reaching a climax at, respectively, the point M and the point N (FIG. 3*d*). In still another embodiment, a limited combination of the numbers E applies to successive sets of cross sections (FIG. 3*e*). For example, a first set of cross sections and a second set of cross sections alternate throughout the line segment M-N. E1 applies to the first set of cross sections and E2 applies to the second set of cross sections, where E1 is greater than E2.

Turning to FIG. 4, in accordance with an exemplary embodiment of the claimed invention, the outer surface of the lamp tube 1 reveals a combination of translucent object that shows itself on a translucent outer surface and opaque object that shows itself on an opaque outer surface. In an embodiment, a translucent object forms all of the outer surface of the lamp tube 1 and no opaque object forms any of the outer surface of the lamp tube 1. In other words, all of the outer surface of the lamp tube 1 is a translucent outer surface. In another embodiment, an opaque object forms an opaque outer surface of the lamp tube 1 and a translucent object forms a translucent outer surface of the lamp tube 1. The opaque outer surface is found in one of the reinforcing portion 107, the light transmissive portion 105, the LED light assembly, the end cap 3, the ridge 235, the maintaining stick 2351, the protruding bar 236 and a combination selected from the above. The opaque outer surface is made of one of pure metal, metal alloy, plastic and a combination selected from the above. Likewise, the translucent outer surface is found in one of the reinforcing portion 107, the light transmissive portion 105, the LED light assembly, the end cap 3, the ridge 235, the maintaining stick 2351 and a combination selected from the above. The reinforcing portion 107 that forms the outer surface of the lamp tube is either the platform 107*a*, the bracing structure 107*b* or both. The bracing structure 107*b* that forms the outer surface of the lamp tube 1 is either the vertical rib, the horizontal rib, the curvilinear rib or a combination selected from the above. The LED light assembly that forms the outer surface of the lamp tube is either the LED light source 202, the LED light strip 2 or both. The LED light strip 2 that forms the outer surface of the lamp tube 1 is either an electronic component, a conductive track, a conductive pad, a via, a substrate or a combination selected from the above. The translucent outer surface is made of one of glass, plastic and a combination selected from the above. In some embodiments, an opaque outer surface and a translucent outer surface are found in a same structure, e.g. a reinforcing portion 107 or an end cap 3. In other embodiments, either an opaque outer surface or a translucent outer surface but not both is found in a structure that forms an outer surface of the lamp tube 1. For example, the reinforcing portion 107 that forms the outer surface of the lamp tube 1 is exclusively opaque but the light transmissive portion 105 that forms the outer surface of the lamp tube 1 is exclusively translucent. The ratio R12 of the overall area of the opaque outer surface to the overall area of the translucent outer surface depends on a desired totality of considerations that we want from a lamp tube such as structural strength, thermal conductivity and luminous output. Other things equal, the greater R12 is, the LED tube lamp is configured to dissipate heat more efficiently due to a greater contact by a thermally conductive (though opaque) outer surface with ambient air but potentially compromise luminous output because the opaque outer surface blocks light coming from within the lamp tube. Preferably, R12 is from 0.05 to 0.99.

Referring to FIG. 4, in accordance with an exemplary embodiment of the claimed invention, the circumference of a cross section of a lamp tube 1 reveals a combination of opaque object and translucent object. In an embodiment, the ratio R13 of the overall length of the opaque object that shows itself on the circumference of a cross section to the overall length of the translucent object that shows itself on the circumference of the cross section is a constant wherever the cross section finds itself on the longitudinal axis of the lamp tube (FIG. 3*a*). Preferably, R13 is from 0.05 to 0.99. Alternatively, R13 is a variable depending on where a cross section finds itself on the longitudinal axis M-N of the lamp tube. Where the lamp tube 1 is a straight tubular structure, a hypothetical line segment M-N is defined horizontally along the longitudinal axis of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R13 goes up from the point M before reaching a climax at the point N (FIG. 3*b*). The LED tube lamp is thus configured to show a greater luminous output toward its left end but greater heat dissipation efficiency toward its right end. Preferably, R13 starts from 0.05 and culminates when it goes up to 0.99. In another embodiment, R13 goes up from both ways from the point M and the point N before reaching a common climax at the point O (FIG. 3*c*). The LED tube lamp is thus configured to show greater luminous output toward both ends but greater heat dissipation efficiency toward the middle. Preferably, R13 starts from 0.05 and culminates when it goes up to 0.99. In yet another embodiment, R13, starting from the point O, goes up both ways before coming to a climax, respectively, at the point M and at the point N (FIG. 3*d*). The LED tube lamp is thus configured to show greater luminous output toward the middle but greater heat dissipation efficiency toward both ends. Preferably, R13 starts from 0.99 and culminates when it goes up to 0.05. In still another embodiment, a limited combination of ratios applies to successive sets of cross sections (FIG. 3*e*). For example, a first set of cross sections and a second set of cross sections alternate throughout the line segment M-N. A ratio R131 applies to the first set of cross sections and a ratio R132 applies to the second set of cross sections, where R131 is greater than R132.

Turning to FIG. 4, in accordance with an exemplary embodiment of the claimed invention, the outer surface of the lamp tube 1 reveals a combination of reinforcing portion 107 that shows itself on a translucent outer surface or an opaque outer surface, i.e. a reinforcing outer surface; and light transmissive portion 105 that shows itself on a translucent outer surface, i.e. a light transmissive outer surface. In an embodiment, a light transmissive portion 105 forms all of the outer surface of the lamp tube 1 and no reinforcing portion 107 forms any of the outer surface of the lamp tube 1. In other words, all of the outer surface of the lamp tube 1 is found in the light transmissive portion 105. In another embodiment, a reinforcing portion 107 forms a reinforcing outer surface of the lamp tube 1 and a light transmissive portion 105 forms a light transmissive outer surface of the lamp tube 1. The reinforcing portion 107 that forms the outer surface of the lamp tube 1 is either the platform 107*a*, the bracing structure 107*b* or both. The bracing structure 107*b* that forms the outer surface of the lamp tube 1 is either the vertical rib, the horizontal rib, the curvilinear rib or a combination selected from the above. The reinforcing portion 107 is made of one of pure metal, metal alloy, plastic and a combination selected from the above. The light transmissive portion 105 is made of one of glass, plastic and a combination selected from the above. The ratio R14 of the overall area of the reinforcing outer surface to the overall area of the light transmissive outer surface depends on a desired totality of considerations that we want from a lamp tube 1 such as structural strength, thermal conductivity and luminous output. Other things equal, the greater R14 is, the LED tube lamp is configured to show greater structural strength and to dissipate heat more efficiently due to a greater contact by a thermally conductive (but probably opaque) outer surface with ambient air but potentially compromise luminous output because the reinforcing outer surface is more likely to block light coming from within the lamp tube. Preferably, R14 is from 0.02 to 1.65.

Referring to FIG. 4, in accordance with an exemplary embodiment of the claimed invention, the circumference of a cross section of a lamp tube 1 reveals a combination of reinforcing portion 107 and light transmissive portion 105. In an embodiment, the ratio R15 of the overall length of the reinforcing portion 107 that shows itself on the circumference of a cross section to the overall length of the light transmissive portion 105 that shows itself on the circumference of the cross section is a constant wherever the cross section finds itself on the longitudinal axis of the lamp tube (FIG. 3*a*). Preferably, R15 is from 0.02 to 1.65. Alternatively, R15 is a variable depending on where a cross section finds itself on the longitudinal axis M-N of the lamp tube 1. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R15 goes up from the point M before reaching a climax at the point N (FIG. 3*b*). The LED tube lamp is thus configured to show a greater luminous output toward its left end but greater heat dissipation efficiency toward its right end. Preferably, R15 starts from 0.02 and culminates when it goes up to 1.65. In another embodiment, R15 goes up from both ways from the point M and the point N before reaching a common climax at the point O (FIG. 3*c*). The LED tube lamp is thus configured to show greater luminous output toward both ends but greater heat dissipation efficiency toward the middle. Preferably, R15 starts from 0.02 and culminates when it goes up to 1.65. In yet another embodiment, R15, starting from the point O, goes up both ways before coming to a climax, respectively, at the point M and at the point N (FIG. 3*d*). The LED tube lamp is thus configured to show greater luminous output toward the middle but greater heat dissipation efficiency toward both ends. Preferably, R15 starts from 0.02 and culminates when it goes up to 1.65. In still another embodiment, a limited combination of ratios applies to successive sets of cross sections (FIG. 3*e*). For example, a first set of cross sections and a second set of cross sections alternate throughout the line segment M-N. A ratio R151 applies to the first set of cross sections and a ratio R152 applies to the second set of cross sections, where R151 is greater than R152.

Turning to FIG. 4, in accordance with an exemplary embodiment of the claimed invention, a cross section of the lamp tube 1 perpendicular to the lamp tube's longitudinal axis M-N reveals a combination of reinforcing portion 107 and light transmissive portion 105. The reinforcing portion 107 is made of one of pure metal, metal alloy and a combination selected from the above. The reinforcing portion 107 that shows itself on the cross section of the lamp tube 1 is either the platform 107*a*, the bracing structure 107*b* or both. The bracing structure 107*b* that shows itself on the cross section of the lamp tube 1 is either the vertical rib, the horizontal rib, the curvilinear rib or a combination selected from the above. The light transmissive portion 105 is made from one of glass, plastic and a combination selected from the above. The ratio R16 of the overall area of the reinforcing portion 107 on a cross section to the overall area of the light transmissive portion 107 on the cross section depends on a desired totality of factors such as structural strength, thermal conductivity and luminous output. Other things equal, the greater R16 is, the LED tube lamp is configured to exhibit greater structural strength, heat dissipation efficiency or both but potentially compromise luminous output because the reinforcing portion 107 is more likely to block light coming from within the lamp tube 1. Preferably, R16 is from 0.02 to 4. Likewise, the ratio R17 of the aggregate of the linear distance around the edge of the reinforcing portion 107 on the cross section to the aggregate of the linear distance around the edge of the light transmissive portion 107 on the same cross section depends on a desired totality of factors such as structural strength, heat dissipation efficiency and luminous output. Other things equal, the greater R17 is, the LED tube lamp is configured to exhibit greater structural strength, heat dissipation efficiency or both but potentially compromise luminous output because the reinforcing portion is more likely to block light coming from within the lamp tube 1. Preferably, R17 is from 0.02 to 1.

The ratios articulated in the preceding paragraph R16, R17 are either constant on each cross section throughout the longitudinal axis M-N of the lamp tube 1 or variable depending on where a cross section finds itself on the longitudinal axis M-N. In an embodiment, R16 (or R17) is a constant regardless of where a cross section finds itself on the longitudinal axis of the lamp tube (FIG. 3*a*). Preferably, R16 is from 0.02 to 4. Preferably, R17 is from 0.02 to 1. In another embodiment, R16 (or R17) is variable depending on the location of the cross section on the longitudinal axis M-N. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R16 (or R17) goes up from the point M before reaching a climax at the point N (FIG. 3*b*). The LED tube lamp is thus configured to show greater heat dissipation efficiency, structural strength or both toward the right end. Preferably, R16 starts from 0.02 and culminates when it goes up to 4. Preferably, R17 starts from 0.02 and culminates when it goes up to 1. In another embodiment, R16 (or R17) goes up from both ways from the point M and the point N before reaching a common climax at the point O (FIG. 3*c*). The LED tube lamp is thus configured to show greater heat dissipation efficiency, structural strength or both toward the middle but greater luminous output toward both ends. Preferably, R16 starts from 0.02 and culminates when it goes up to 4. Preferably, R17 starts from 0.02 and culminates when it goes up to 1. In yet another embodiment, R16 (or R17), starting from the point O, goes up both ways before coming to a climax, respectively, at the point M and at the point N (FIG. 3*d*). The LED tube lamp is thus configured to show greater luminous output toward the middle but greater heat dissipation efficiency, structural or both toward both ends. Preferably, R16 starts from 4 and culminates when it goes up to 0.02. Preferably, R17 starts from 1 and culminates when it goes up to 0.02. In still another embodiment, a limited combination of ratios applies to successive sets of cross sections (FIG. 3*e*). For example, a first set of cross sections and a second set of cross sections alternate throughout the line segment M-N. A ratio R161 (or R171) applies to the first set of cross sections and a ratio R162 (or R172) applies to the second set of cross sections, where R161 (or R171) is greater than R162 (or R172).

Figure 6:
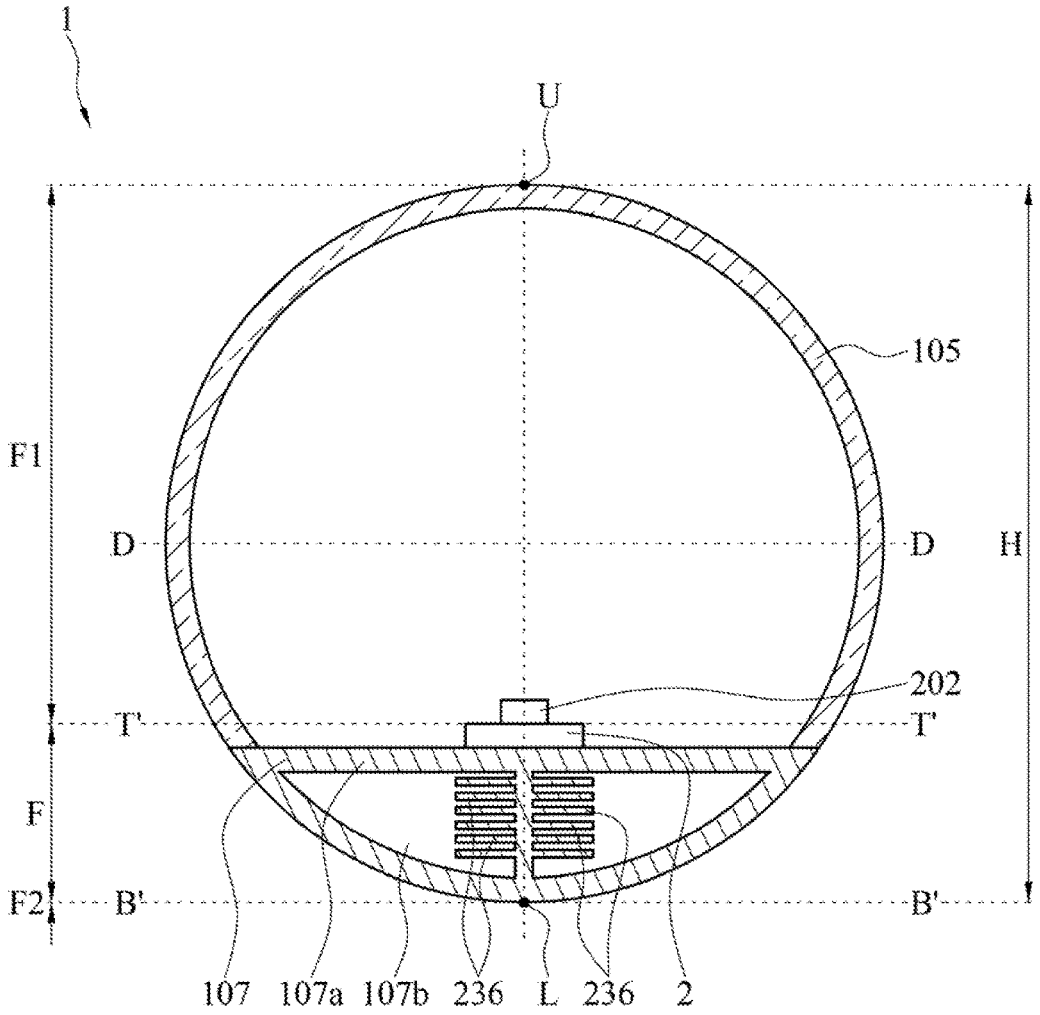
FIG. 6 is a cross-sectional view of the lamp tube in FIG. 1 along 2-2.

Turning to FIG. 6, a cross section of the lamp tube 1 perpendicular to its longitudinal axis M-N also reveals a spatial distribution, observable from various perspectives, of the reinforcing portion 107 on a cross section in relation to the light transmissive portion 105 on the cross section. In an embodiment, a hypothetical line segment U-L vertically bisects a cross section of the lamp tube 1 into two segments having an identical length horizontally. The line segment U-L includes an upper endpoint U and a lower endpoint L, both endpoints falling on the circumference of the cross section. Where the lamp tube 1 takes the shape of a circular cylinder, the cross section of the lamp tube 1 defines a hypothetical circle. The line segment U-L vertically bisects the circle along the diameter into two equal halves. The length of the line segment U-L from the point U to the point L, i.e. the diameter of the circle, is H. The line T'-T' is the lowest horizontal line on the cross section above which no reinforcing portion 107 is found. The line B'-B' is the highest horizontal line on the cross section below which no reinforcing portion 107 is found. The distance from the line T'-T' to the line B'-B' is F. The distance from the point U to the line T'-T' is F1. The distance from the point L to the line B'-B' is F2. Respective ratios R18 (F/H), R19 (F1/H), R20 (F2/H) depend on a desired totality of advantages that an LED tube lamp is expected to have including structural strength, thermal conductivity and luminous output. Other things equal, the greater R18 or R20 is, the LED tube lamp is configured to exhibit greater heat dissipation efficiency, structural strength or both because more heat is taken away from the center of lamp tube 1 but potentially compromise luminous output. Preferably, R18 is from 0.05 to 0.4. Preferably, R20 is from 0 to 0.45. Other things equal, the greater R19 is, the LED tube lamp is configured to shed light across a wider angle because the light transmissive portion 105 is generally bigger. Preferably, R19 is from 0.6 to 0.95.

The ratios articulated in the preceding paragraph R18, R19, R20 are either constant on each cross section across the longitudinal axis M-N of the lamp tube 1 or variable depending on where a cross section finds itself on the longitudinal axis M-N. In an embodiment, R18 (or R19, R20) is a constant regardless of where a cross section finds itself on the longitudinal axis M-N of the lamp tube 1 (FIG. 3*a*). Preferably, R18 is from 0.05 to 0.4. Preferably, R19 is from 0.6 to 0.95. Preferably, R20 is from 0 to 0.45. In another embodiment, R18 (or R19, R20) is a variable depending on the location of the cross section on the longitudinal axis. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R18 (or R19, R20) goes up from the point M before reaching a climax at the point N (FIG. 3*b*). When the ratio refers to R18, the LED tube lamp is thus configured to show greater luminous output toward the left end but greater heat dissipation efficiency toward the right end. When the ratio refers to R19 or R20, the LED tube lamp is thus configured to show greater luminous output toward the right end but greater heat dissipation efficiency toward the left end. Preferably, R18 starts from 0.05 and culminates when it goes up to 0.4. Preferably, R19 starts from 0.6 and culminates when it goes up to 0.95. Preferably, R20 starts from 0 and culminates when it goes up to 0.45. In another embodiment, R18 (or R19, R20) goes up from both ways from the point M and the point N before reaching a common climax at the point M. When the ratio refers to R18, the LED tube lamp is thus configured to show greater luminous output toward both ends but greater heat dissipation efficiency toward the middle (FIG. 3*c*). When the ratio refers to R19 or R20, the LED tube lamp is thus configured to show greater luminous output toward the middle but greater heat dissipation efficiency toward the both ends. Preferably, R18 starts from 0.05 and culminates when it goes up to 0.4. Preferably, R19 starts from 0.6 and culminates when it goes up to 0.95. Preferably, R20 starts from 0 and culminates when it goes up to 0.45. In yet another embodiment, R18 (or R19, R20), starting from the point O, goes up both ways before coming to a climax, respectively, at the point M and at the point N (FIG. 3*d*). When the ratio refers to R18, the LED tube lamp is thus configured to show greater luminous output toward the middle but greater heat dissipation efficiency toward both ends. When the ratio refers to R19 or R20, the LED tube lamp is thus configured to show greater luminous output toward both ends but greater heat dissipation efficiency toward the middle. Preferably, R18 starts from 0.05 and culminates when it goes up to 0.4. Preferably, R19 starts from 0.6 and culminates when it goes up to 0.95. Preferably, R20 starts from 0 and culminates when it goes up to 0.45. In still another embodiment, a limited combination of ratios applies to successive sets of cross sections (FIG. 3*e*). For example, a first set of cross sections and a second set of cross sections alternate throughout the line segment M-N. A ratio R181 (or R191, R201) applies to the first set of cross sections and a ratio R182 (or R192, R202) applies to the second set of cross sections, where R181 (or R191, R201) is greater than R182 (or R192, R202).

Turning to FIG. 7, when an outer surface of the lamp tube 1 includes a plastic outer surface, the plastic outer surface of the lamp tube 1 reveals a combination of thermally conductive plastic that shows itself on the plastic outer surface, i.e. the thermally-conductive plastic outer surface and light transmissive plastic that shows itself on the plastic outer surface, i.e. the light-transmissive plastic outer surface. In an embodiment, a light-transmissive plastic outer surface forms all of the plastic outer surface of the lamp tube 1 and no thermally-conductive plastic outer service forms any of the plastic outer surface of the lamp tube 1. In other words, all of the plastic outer surface of the lamp tube 1 is a light-transmissive plastic outer surface. In another embodiment, thermally-conductive plastic forms a thermally-conductive plastic outer surface of the lamp tube 1 and light transmissive plastic forms a light-transmissive plastic outer surface of the lamp tube 1. The thermally conductive plastic is found in one of the reinforcing portion 107, the LED light assembly, the end cap 3, the ridge 235, the maintaining stick 2351, the protruding bar 236 and a combination selected from the above. Likewise, the light transmissive plastic is found in one of the light transmissive portion 105, the LED light assembly, the end cap 3 and a combination selected from the above. The reinforcing portion 107 that forms the thermally-conductive plastic outer surface of the lamp tube 1 is either the platform 107*a*, the bracing structure 107*b* or both. The bracing structure 107*b* that forms the thermally-conductive plastic outer surface of the lamp tube 1 is either the vertical rib, the horizontal rib, the curvilinear rib or a combination selected from the above. The LED light assembly that forms the thermally-conductive plastic outer surface of the lamp tube 1 is either the LED light source 202, the LED light strip 2 or both. The LED light strip 2 that forms the thermally-conductive plastic outer surface of the lamp tube 1 is either an electronic component, a conductive track, a conductive pad, a via, a substrate or a combination selected from the above. The light transmissive plastic is one of translucent polymer matrices such as polymethyl methacrylate, polycarbonate, polystyrene, poly(styrene-co-methyl methacrylate) or a mixture selected from the above. Optionally, the strength and elasticity of thermally conductive plastic is enhanced by bonding a plastic matrix with glass fibers. When a lamp tube 1 employs a combination of light transmissive plastic and thermally conductive plastic, the light transmissive plastic exhibits a greater optical transmittance but less thermal conductivity and structural strength than the thermally conductive plastic does in the combination. In some embodiments, a light-transmissive plastic outer surface and a thermally-conductive plastic outer surface are found in a same structure, e.g. a reinforcing portion 107 or an end cap 3. In other embodiments, either a light-transmissive plastic outer surface or a thermally-conductive plastic outer surface but not both is found in a structure that forms a plastic outer surface of the lamp tube. For example, the reinforcing portion 107 that forms the plastic outer surface of the lamp tube 1 is exclusively made from thermally conductive plastic but the light transmissive portion 105 that forms the plastic outer surface of the lamp tube 1 is exclusively made from light transmissive plastic. The ratio R21 of the overall area of the thermally-conductive plastic outer surface to the overall area of the light-transmissive plastic outer surface depends on a desired totality of considerations that we want from a lamp tube 1 such as structural strength, thermal conductivity and luminous output. Other things equal, the greater R21 is, the LED tube lamp is configured to dissipate heat more efficiently due to a greater contact by the thermally-conducive plastic outer surface with ambient air but potentially compromise luminous output because the thermally-conductive plastic outer surface is more likely to block light coming from within the lamp tube. Preferably, R21 is from 0.05 to 1.

Referring to FIG. 7, in accordance with an exemplary embodiment of the claimed invention, the circumference of a cross section of a lamp tube 1 reveals a combination of thermally conductive plastic and light transmissive plastic. In an embodiment, the ratio R22 of the overall length of the thermally conductive plastic that shows itself on the circumference of a cross section of the lamp tube 1 to the overall length of the light transmissive plastic that shows itself on the circumference of the cross section is a constant wherever the cross section finds itself on the longitudinal axis of the lamp tube (FIG. 3*a*). Preferably, R22 is from 0.05 to 1. Alternatively, R22 is a variable depending on where a cross section finds itself on the longitudinal axis M-N of the lamp tube 1. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R22 goes up from the point M before reaching a climax at the point N (FIG. 3*b*). The LED tube lamp is thus configured to show a greater luminous output toward its left end but greater heat dissipation efficiency toward its right end. Preferably, R22 starts from 0.05 and culminates when it goes up to 1. In another embodiment, R22 goes up from both ways from the point M and the point N before reaching a common climax at the point O (FIG. 3*c*). The LED tube lamp is thus configured to show greater luminous output toward both ends but greater heat dissipation efficiency toward the middle. Preferably, R22 starts from 0.05 and culminates when it goes up to 1. In yet another embodiment, R22, starting from the point O, goes up both ways before coming to a climax, respectively, at the point M and at the point N (FIG. 3*d*). The LED tube lamp is thus configured to show greater luminous output toward the middle but greater heat dissipation efficiency toward both ends. Preferably, R22 starts from 1 and culminates when it goes up to 0.05. In still another embodiment, a limited combination of ratios applies to successive sets of cross sections. For example, a first set of cross sections and a second set of cross sections alternate throughout the line segment M-N (FIG. 3*e*). A ratio R221 applies to the first set of cross sections and a ratio R222 applies to the second set of cross sections, where R221 is greater than R222.

Turning to FIG. 7, in accordance with an exemplary embodiment of the claimed invention, a cross section of the lamp tube 1 perpendicular to the lamp tube's longitudinal axis M-N reveals a combination of objects made of materials having a variety of stiffness. Depending on the materials from which they are made, the objects are roughly divided into "stiff" objects that are primarily configured to boost structural strength, thermal conductivity or both and "soft" objects that are configured for other functions, e.g. to be light transmissive, to cut cost, to reduce weight and to prevent electric shock. Stiff objects are found in one of the reinforcing portion 107, the light transmissive portion 105, the LED light assembly, the end cap 3, the ridge 235, the maintaining stick 2351, the protruding bar 236 and a combination selected from the above. The stiff object is made of one of pure metal, metal alloy, thermally-conductive plastic and a combination selected from the above. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. Soft objects are found in one of the reinforcing portion 107, the light transmissive portion 105, the LED light assembly, the end cap 3, the ridge 235, the maintaining stick 2351, the protruding bar 236 and a combination selected from the above. The reinforcing portion 107 that shows itself on the cross section of the lamp tube 1 is either the platform 107*a*, the bracing structure 107*b* or both. The bracing structure 107*b* that shows itself on the cross section of the lamp tube 1 is either the vertical rib, the horizontal rib, the curvilinear rib or a combination selected from the above. The LED light assembly that shows itself on the cross section of the lamp tube 1 is either the LED light source 202, the LED light strip 2 or both. The LED light strip 2 that is found on the cross section of the lamp tube 1 is either an electronic component, a conductive track, a conductive pad, a via, a substrate or a combination selected from the above. The soft object is made from one of light transmissive plastic, glass, rubber and a combination selected from the above. The light transmissive plastic is one of translucent polymer matrices such as polymethyl methacrylate, polycarbonate, polystyrene, poly(styrene-co-methyl methacrylate) or a mixture selected from the above. In some embodiments, materials having distinct stiffness are found in a same structure. For example, a reinforcing portion 107 has a first rib made of aluminum and a second rib made of thermally conductive plastic. Likewise, a light transmissive portion 105 has a light-transmissive plastic tube coaxially sheathed by a glass tube. In other embodiments, only one single material is found in a same structure that shows itself on a cross section of the lamp tube. For example, the reinforcing portion 107 that is found on the cross section of the lamp tube 1 is exclusively made of aluminum but the light transmissive portion 105 that is found on the same cross section of the lamp tube 1 is exclusively plastic. The number of groups of materials categorized by stiffness found in a cross section of a lamp tube 1 is G. In an embodiment, the cross section reveals exactly one type of material and G equals one. In another embodiment, the cross section reveals materials having a plurality of stiffness. Thus, G is greater than one. Preferably, G is an integer from 5 to 15.

The integer G articulated in the preceding paragraph is either constant on each cross section throughout the longitudinal axis M-N of the lamp tube 1 or variable depending on where a cross section finds itself on the longitudinal axis M-N. In an embodiment, G is a constant regardless of where a cross section finds itself on the longitudinal axis M-N of the lamp tube 1 (FIG. 3*a*). Preferably, G is an integer from 5 to 15. In another embodiment, G is a variable depending on the location of the cross section on the longitudinal axis M-N. Where the lamp tube 1 is a straight tubular structure, a hypothetical line segment M-N is defined horizontally along the longitudinal axis of the lamp tube 1. The endpoint M sits at the leftmost end of the lamp tube 1. The endpoint N sits at the rightmost end of the lamp tube 1. The middle point O bisects the line segment M-N into two equal halves. In an embodiment, G goes up from the point M until reaching a climax at the point N (FIG. 3*b*). Preferably, G starts from 5 and culminates when it goes up to 15. In another embodiment, G goes up from both ways from the point M and from the point N before reaching a climax at the point O (FIG. 3*c*). Preferably, G starts from 5 and culminates when it goes up to 15. In yet another embodiment, G goes up both ways from the point O until reaching a climax at, respectively, the point M and the point N (FIG. 3*d*). Preferably, G starts from 5 and culminates when it goes up to 15. In still another embodiment, a limited combination of the numbers G applies to successive sets of cross sections (FIG. 3*e*). For example, a first set of cross sections and a second set of cross sections alternate throughout the line segment M-N. G1 applies to the first set of cross sections and G2 applies to the second set of cross sections, where G1 is greater than G2.

Referring to FIG. 7, when the integer G articulated in the preceding paragraph is equal to or greater than two, the ratio R23 of the overall area of all objects having greatest stiffness on a cross section to the overall area of all other objects having less stiffness on the cross section depends on a desired totality of factors such as structural strength, heat dissipation efficiency and luminous output. Other things equal, the greater R23 is, the LED tube lamp is configured to exhibit greater structural strength, thermal conductivity or both but potentially compromise luminous output because a stiff object is more likely to block light coming from within the lamp tube. Preferably, R23 is from 0.005 to 0.1. Likewise, the ratio R24 of the aggregate of the linear distance around the edge of all objects having greatest stiffness on the cross section to the aggregate of the linear distance around the edge of all other objects having less stiffness on the same cross section depends on a desired totality of factors such as structural strength, thermal conductivity and luminous output. Other things equal, the greater R24 is, the LED tube lamp is configured to exhibit greater structural strength, thermal conductivity or both but potentially compromise luminous output because the stiffer object is more likely to block light coming from within the lamp tube 1. Preferably, R24 is from 0.005 to 1.65.

Tuning to FIG. 7, a cross section of the lamp tube 1 perpendicular to the lamp tube's longitudinal axis M-N contains a subset of the cross section revealing one of the reinforcing portion 107, the ridge 235, the maintaining stick 2351, the protruding bar 236 and a combination selected from above. In accordance with an exemplary embodiment of the claimed invention, the subset of the cross section reveals a combination of objects made of materials having a variety of stiffness. Depending on the materials from which they are made, the objects are roughly divided into "stiff" objects that are primarily configured to boost structural strength, thermal conductivity or both and "soft" objects that are configured to for other functions, e.g. to be light transmissive, to cut cost, to reduce weight and to prevent electric shock. The stiff object is made of one of pure metal, metal alloy, thermally-conductive plastic and a combination selected from the above. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. The reinforcing portion 107 that shows itself on the subset of the cross section of the lamp tube 1 is either the platform 107*a*, the bracing structure 107*b* or both. The bracing structure 107*b* that shows itself on the subset of the cross section of the lamp tube 1 is either the vertical rib, the horizontal rib, the curvilinear rib or a combination selected from the above. The soft object is made from one of light transmissive plastic, glass, rubber and a combination selected from the above. The light transmissive plastic is one of translucent polymer matrices such as polymethyl methacrylate, polycarbonate, polystyrene, poly(styrene-co-methyl methacrylate) or a mixture selected from the above. In some embodiments, materials having distinct stiffness are found in a same structure. For example, a reinforcing portion 107 has a first rib made of aluminum and a second rib made of thermally conductive plastic. In other embodiments, only one single material is found in a same structure that shows itself on the subset of the cross section of the lamp tube. For example, the maintaining stick 2351 that that is found on the subset of the cross section of the lamp tube 1 is exclusively made of aluminum but the ridge 235 that is found on the same subset of the cross section of the lamp tube 1 is exclusively plastic. The number of groups of materials categorized by stiffness found in the subset of the cross section of a lamp tube 1 is K. In an embodiment, the subset of the cross section reveals exactly one type of material and K equals one. In another embodiment, the subset of the cross section reveals materials having a plurality of distinct stiffness. Thus, K is greater than one. Preferably, K is an integer from 5 to 15.

Referring to FIG. 7. when the integer K articulated in the preceding paragraph is equal to or greater than two, the ratio R25 of the overall area of all objects having greatest stiffness on the subset of the cross section to the overall area of all other objects having less stiffness on the subset of the cross section depends on a desired totality of factors such as structural strength, thermal conductivity and luminous output. Other things equal, the greater R25 is, the LED tube lamp is configured to exhibit greater structural strength, thermal conductivity or both but potentially compromise luminous output because a stiff object is more likely to block light coming from within the lamp tube 1. Preferably, R25 is from 0.02 to 4. Likewise, the ratio R26 of the aggregate of the linear distance around the edge of all objects having greatest stiffness on the subset of the cross section to the aggregate of the linear distance around the edge of all other objects having less stiffness on the same subset of the cross section depends on a desired totality of factors such as structural strength, thermal conductivity and luminous output. Other things equal, the greater R26 is, the LED tube lamp is configured to exhibit greater structural strength, thermal conductivity or both but potentially compromise luminous output because stiffer objects are more likely to block light coming from within the lamp tube 1. Preferably, R26 is from 0.02 to 1.

The ratios R25, R26 articulated in the preceding paragraph are either constant on each cross section throughout the longitudinal axis M-N of the lamp tube 1 or variable depending on where a cross section finds itself on the longitudinal axis M-N. In an embodiment, R25 (or R26) is a constant regardless of where a cross section finds itself on the longitudinal axis M-N of the lamp tube 1 (FIG. 3*a*). Preferably, R25 is from 0.02 to 4. Preferably, R26 is from 0.02 to 1. In another embodiment, R25 (or R26) is a variable depending on the location of the cross section on the longitudinal axis M-N. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R25 (or R26) goes up from the point M until reaching a climax at the point N (FIG. 3*b*). Preferably, R25 starts from 0.02 and culminates when it goes up to 4. Preferably, R26 starts from 0.02 and culminates when it goes up to 1. In another embodiment, R25 (or R26) goes up from both ways from the point M and from the point N before reaching a climax at the point O (FIG. 3*c*). Preferably, R25 starts from 0.02 and culminates when it goes up to 4. Preferably, R26 starts from 0.02 and culminates when it goes up to 1. In yet another embodiment, R25 (or R26) goes up both ways from the point O until reaching a climax at, respectively, the point M and the point N (FIG. 3*d*). Preferably, R25 starts from 4 and culminates when it goes up to 0.02. Preferably, R26 starts from 1 and culminates when it goes up to 0.02. In still another embodiment, a limited combination of the numbers R25 (or R26) apply to successive sets of cross sections (FIG. 3*e*). For example, a first set of cross sections and a second set of cross sections alternate throughout the line segment M-N. R251 (or R261) applies to the first set of cross sections and R252 (or R262) applies to the second set of cross sections, where R251 (or R261) is greater than R252 (or R262).

Turning to FIG. 7, a cross section of the lamp tube 1 perpendicular to the lamp tube's longitudinal axis M-N contains a subset of the cross section revealing one of the reinforcing portion 107, a ridge 235, a protruding bar 236, a maintaining stick 2351 and a combination selected from above. In accordance with an exemplary embodiment of the claimed invention, the subset of the cross section reveals a combination of metallic objects and plastic objects. The metallic object is made of pure metal, metal alloy or both. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. The reinforcing portion 107 that shows itself on the subset of the cross section of the lamp tube 1 is either the platform 107*a*, the bracing structure 107*b* or both. The bracing structure 107*b* that shows itself on the subset of the cross section of the lamp tube 1 is either the vertical rib, the horizontal rib, the curvilinear rib or a combination selected from the above. The plastic object is made from one of light transmissive plastic, thermally conductive plastic, rubber and a combination selected from the above. The light transmissive plastic is one of translucent polymer matrices such as polymethyl methacrylate, polycarbonate, polystyrene, poly(styrene-co-methyl methacrylate) or a mixture selected from the above. In some embodiments, a metallic object and a plastic object are found in a same structure. For example, a reinforcing portion 107 has a first rib made of aluminum and a second rib made of thermally conductive plastic. In other embodiments, only a metallic object or a plastic object but not both is found in a same structure that shows itself on a subset of a cross section of the lamp tube 1. For example, the maintaining stick 2351 that that is found on the subset of the cross section of the lamp tube 1 is exclusively made of aluminum but the ridge 235 that is found on the same subset of the cross section of the lamp tube 1 is exclusively plastic. The number of types of metal and the number of types of plastic found in the subset of the cross section of the lamp tube 1 are, respectively, P and Q. In an embodiment, the subset of the cross section reveals exactly one type of metal and one type of plastic. Thus, P equals one and Q equals one. In another embodiment, the subset of the cross section reveals a plurality of types of metal and a plurality of types of plastic. Thus, P is greater than one and Q is greater than one. Preferably, P is an integer from 2 to 10. Preferably, Q is an integer from 1 to 5.

The integers P, Q articulated in the preceding paragraph are either constant on each cross section throughout the longitudinal axis M-N of the lamp tube 1 or variable depending on where a cross section finds itself on the longitudinal axis M-N. In an embodiment, P (or Q) is a constant regardless of where a cross section finds itself on the longitudinal axis M-N of the lamp tube 1 (FIG. 3*a*). Preferably, P is from 2 to 10. Preferably, Q is from 1 to 5. In another embodiment, P (or Q) is a variable depending on the location of the cross section on the longitudinal axis M-N. Where the lamp tube 1 is a straight tubular structure, a hypothetical line segment M-N is defined horizontally along the longitudinal axis of the lamp tube 1. The endpoint M sits at the leftmost end of the lamp tube 1. The endpoint N sits at the rightmost end of the lamp tube 1. The middle point O bisects the line segment M-N into two equal halves. In an embodiment, P (or Q) goes up from the point M until reaching a climax at the point N (FIG. 3*b*). Preferably, P starts from 2 and culminates when it goes up to 10. Preferably, Q starts from 1 and culminates when it goes up to 5. In another embodiment, P (or Q) goes up from both ways from the point M and from the point N before reaching a climax at the point O (FIG. 3*c*). Preferably, P starts from 2 and culminates when it goes up to 10. Preferably, Q starts from 1 and culminates when it goes up to 5. In yet another embodiment, P (or Q) goes up both ways from the point O until reaching a climax at, respectively, the point M and the point N (FIG. 3*d*). Preferably, P starts from 2 and culminates when it goes up to 10. Preferably, Q starts from 1 and culminates when it goes up to 5. In still another embodiment, a limited combination of the numbers P (or Q) apply to successive sets of cross sections (FIG. 3*e*). For example, a first set of cross sections and a second set of cross sections alternate throughout the line segment M-N. P 1 (or Q1) applies to the first set of cross sections and P2 (or Q2) applies to the second set of cross sections, where P 1 (or Q1) is greater than P2 (or Q2).

Turning to FIG. 7, a cross section of the lamp tube 1 perpendicular to the lamp tube's longitudinal axis M-N contains a subset of the cross section revealing one of the reinforcing portion 107, a ridge 235, a maintaining stick 2351, a protruding bar 236 and a combination selected from above. In accordance with an exemplary embodiment of the claimed invention, the subset of the cross section reveals a combination of metallic objects and nonmetallic objects. In an embodiment, metallic objects form all of the subset of the cross section but no nonmetallic objects form any of the subset of the cross section. In another embodiment, a metallic object and a nonmetallic object find themselves on the subset of the cross section. The reinforcing portion 107 that finds itself on the subset of the cross section is either the platform 107*a*, the bracing structure 107*b* or both. The bracing structure 107*b* that finds itself on the subset of the cross section is either the vertical rib, the horizontal rib, the curvilinear rib or a combination selected from the above. The metallic object is made of one of pure metal, metal alloy and a combination selected from the above. The metal is one of carbon steel, cast steel, nickel chrome steel, alloyed steel, ductile iron, grey cast iron, white cast iron, rolled manganese bronze, rolled phosphor bronze, cold-drawn bronze, rolled zinc, aluminum alloy and copper alloy. The nonmetallic object is made of one of glass, thermally conductive plastic, light transmissive plastic, rubber and a combination selected from the above. The light transmissive plastic is one of translucent polymer matrices such as polymethyl methacrylate, polycarbonate, polystyrene, poly(styrene-co-methyl methacrylate) or a mixture selected from the above. The ratio R27 of the overall area of the metallic objects on the subset of the cross section to the overall area of the nonmetallic objects on the subset of the cross section depends on a desired totality of considerations that we want from a lamp tube 1 such as structural strength, thermal conductivity and luminous output. Other things equal, the greater R27 is, the LED tube lamp is configured to show greater heat dissipation efficiently, structural strength or both but potentially compromise luminous output because a metallic object is more likely to block light coming from within the lamp tube. Preferably, R27 is from 0 to 0.5.

The ratio R27 articulated in the preceding paragraph is either constant on each cross section throughout the longitudinal axis M-N of the lamp tube 1 or variable depending on where a cross section finds itself on the longitudinal axis M-N. In an embodiment, R27 is a constant regardless of where a cross section finds itself on the longitudinal axis M-N of the lamp tube 1 (FIG. 3*a*). Preferably, R27 is from 0 to 0.5. In another embodiment, R27 is a variable depending on the location of the cross section on the longitudinal axis M-N. Where the lamp tube 1 is a straight tubular structure, a hypothetical line segment M-N is defined horizontally along the longitudinal axis M-N of the lamp tube 1. The endpoint M sits at the leftmost end of the lamp tube 1. The endpoint N sits at the rightmost end of the lamp tube 1. The middle point O bisects the line segment M-N into two equal halves. In an embodiment, R27 goes up from the point M until reaching a climax at the point N (FIG. 3*b*). Preferably, R27 starts from 0 and culminates when it goes up to 0.5. In another embodiment, R27 goes up from both ways from the point M and from the point N before reaching a climax at the point O (FIG. 3*c*). Preferably, R27 starts from 0 and culminates when it goes up to 0.5. In yet another embodiment, R27 goes up both ways from the point O until reaching a climax at, respectively, the point M and the point N (FIG. 3*d*). Preferably, R27 starts from 0 and culminates when it goes up to 0.5. In still another embodiment, a limited combination of the numbers R27 apply to successive sets of cross sections (FIG. 3*e*). For example, a first set of cross sections and a second set of cross sections alternate throughout the line segment M-N. R271 applies to the first set of cross sections and R272 applies to the second set of cross sections, where R271 is greater than R272.

Figure 9:
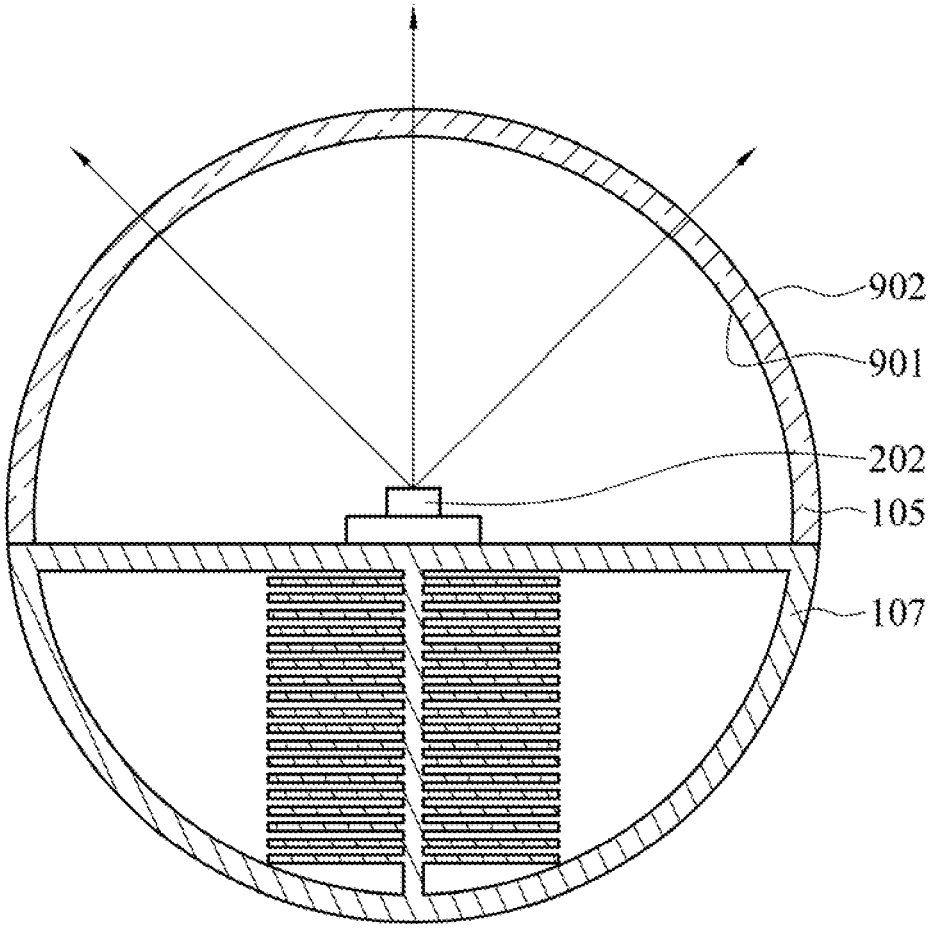
FIG. 9 is a cross-sectional view of the lamp tube in FIG. 1 along 2-2.

The light transmissive portion of a lamp tube, potentially functioning as a lens when light from the LED light source passes through it, includes an outer optical surface and an inner optical surface. When the two optical surfaces have an equal curvature, the light transmissive portion has no optical power. In other words, the light transmissive portion would neither converge nor diverge light coming from the LED light source though a real lens, which has nonzero thickness, is always slightly positive. Alternatively, the outer optical surface has a different curvature from that of the inner optical surface. The light transmissive portion is thus configured to either focus or disperse the light beaming from the LED light source in a desired fashion by means of refraction. When the lamp tube takes the shape of a circular cylinder, the light transmissive portion forms a cylindrical lens. Turning to FIG. 9, in an embodiment, the inner optical surface 901 and the outer optical surface 902 are both convex and have an equal radius of curvature, making the light transmissive portion 105 an equiconvex cylindrical lens. Thus, the light transmissive portion 105 neither focuses nor disperses light coming from the LED light source 202.

The light transmissive portion of a lamp tube, potentially functioning as a lens when light from the LED light source passes through it, includes an outer optical surface and an inner optical surface. When the two optical surfaces have an equal curvature, the light transmissive portion has no optical power. In other words, the light transmissive portion would neither converge nor diverge light coming from the LED light source though a real lens, which has nonzero thickness, is always slightly positive. Alternatively, the outer optical surface has a different curvature from that of the inner optical surface. The light transmissive portion is thus configured to either focus or disperse the light beaming from the LED light source in a desired fashion by means of refraction. When the lamp tube takes the shape of a circular cylinder, the light transmissive portion forms a cylindrical lens. Turning to FIG. 9, in an embodiment, the inner optical surface 901 and the outer optical surface 902 are both convex and have an equal radius of curvature, making the light transmissive portion 105 an equiconvex cylindrical lens. Thus, the light transmissive portion 105 neither focuses nor disperses light coming from the LED light source 202.

Figure 10:
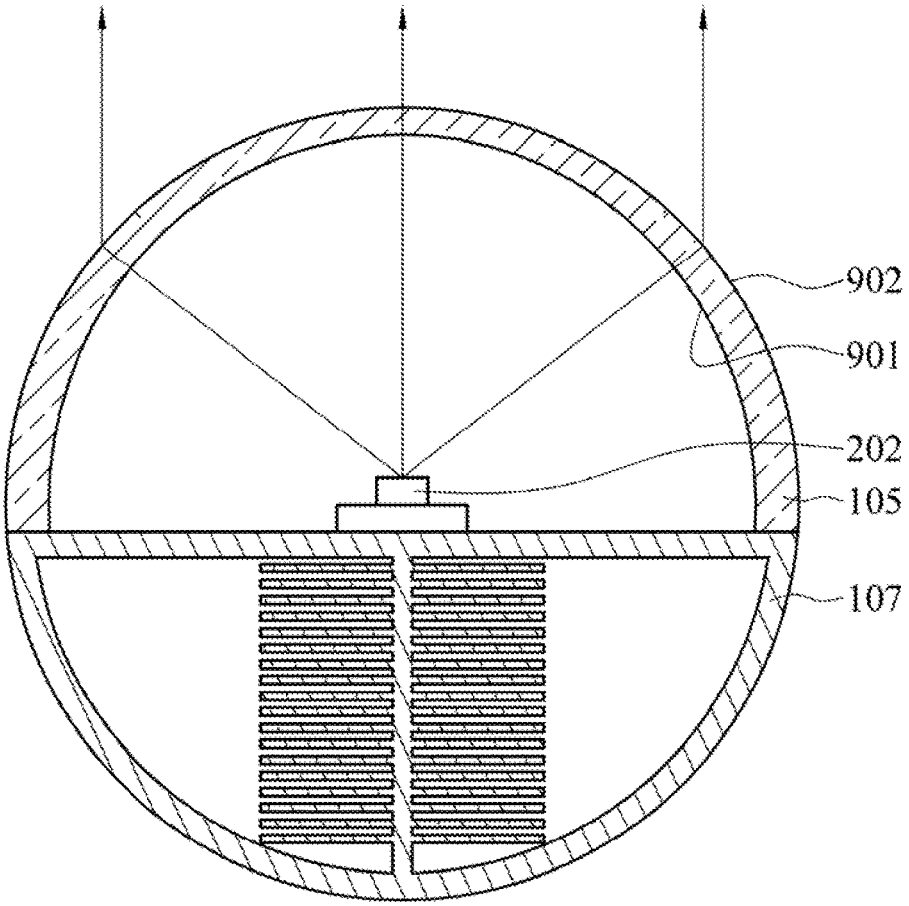
FIG. 10 is a cross-sectional view of the lamp tube in FIG. 1 along 2-2.
Figure 11:
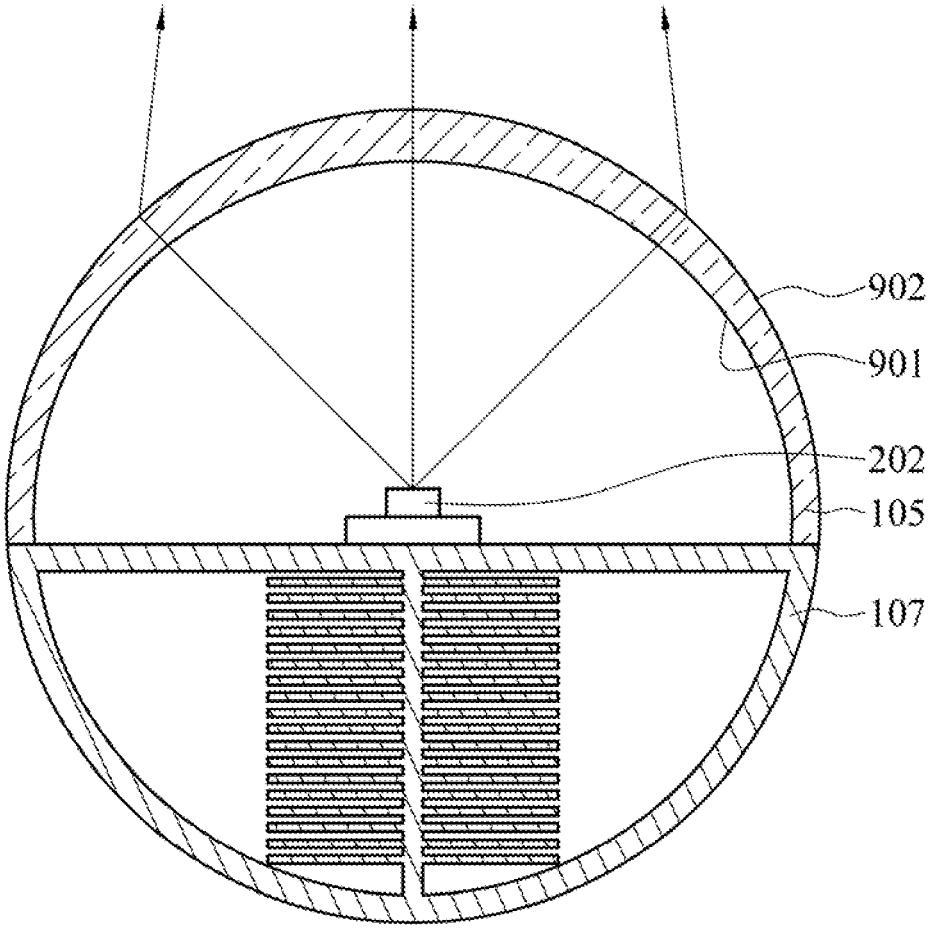
FIG. 11 is a cross-sectional view of the lamp tube in FIG. 1 along 2-2.

In another embodiment, the outer optical surface is convex but the inner optical surface is concave, making the light transmissive portion a meniscus cylindrical lens. Turning to FIG. 10, in some embodiments, the concave outer optical surface 902 is steeper than the convex inner optical surface 901, making the light transmissive portion 105 thinner at the center than at the periphery. The light transmissive portion 105 is thus configured to convert light coming from the LED light source 202 into a converged beam like what a collimator does. Turning to FIG. 11, in other embodiments, the convex outer optical surface 902 is steeper than the concave inner surface 901, making the light transmissive portion 105 thicker at the center than at the periphery. The light transmissive portion 105 is thus configured to convert light coming from the LED light source 202 into a focused beam of light.

Figure 12:
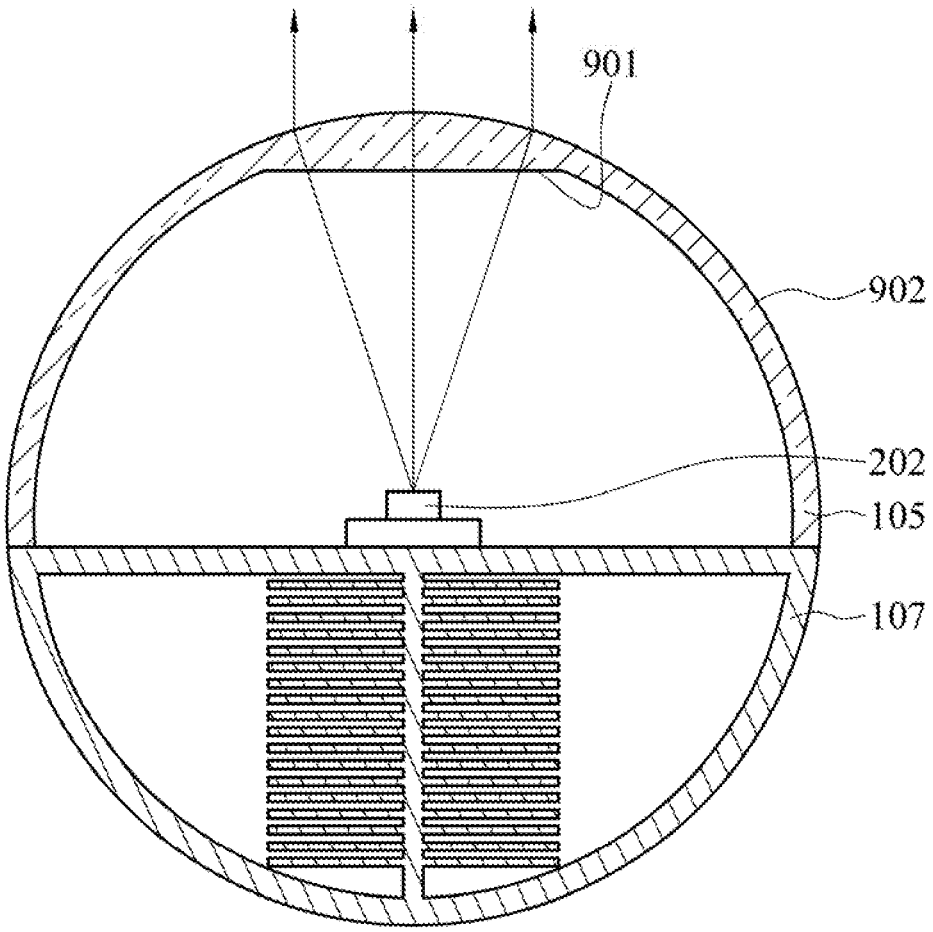
FIG. 12 is a cross-sectional view of the lamp tube in FIG. 1 along 2-2.
Figure 13:
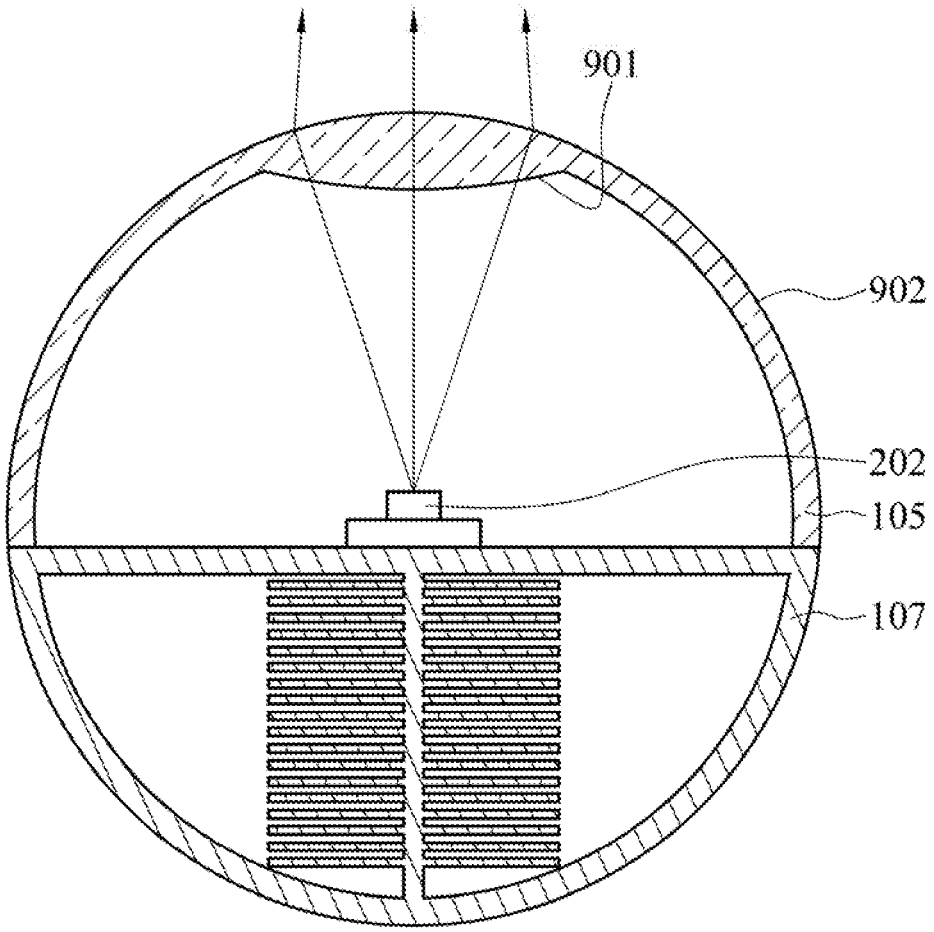
FIG. 13 is a cross-sectional view of the lamp tube in FIG. 1 along 2-2.

In yet another embodiment, the outer optical surface is convex but the inner optical surface is either planar or also convex. Turning to FIG. 12, in some embodiments, a portion of the inner optical surface 901 is planar, making a portion of the light transmissive portion 105 a plano-convex cylindrical lens. The portion of the light transmissive portion 105 is thus configured to convert light coming from the LED light source 202 into a collimated beam of light. Turning to FIG. 13, in other embodiments, the inner optical surface 901 is also convex, making the light transmissive portion 105 a bi-convex cylindrical lens. Functionally similarly, the light transmissive portion 105 is configured to convert light coming from the LED light source 202 into a collimated beam of light.

Figure 14:
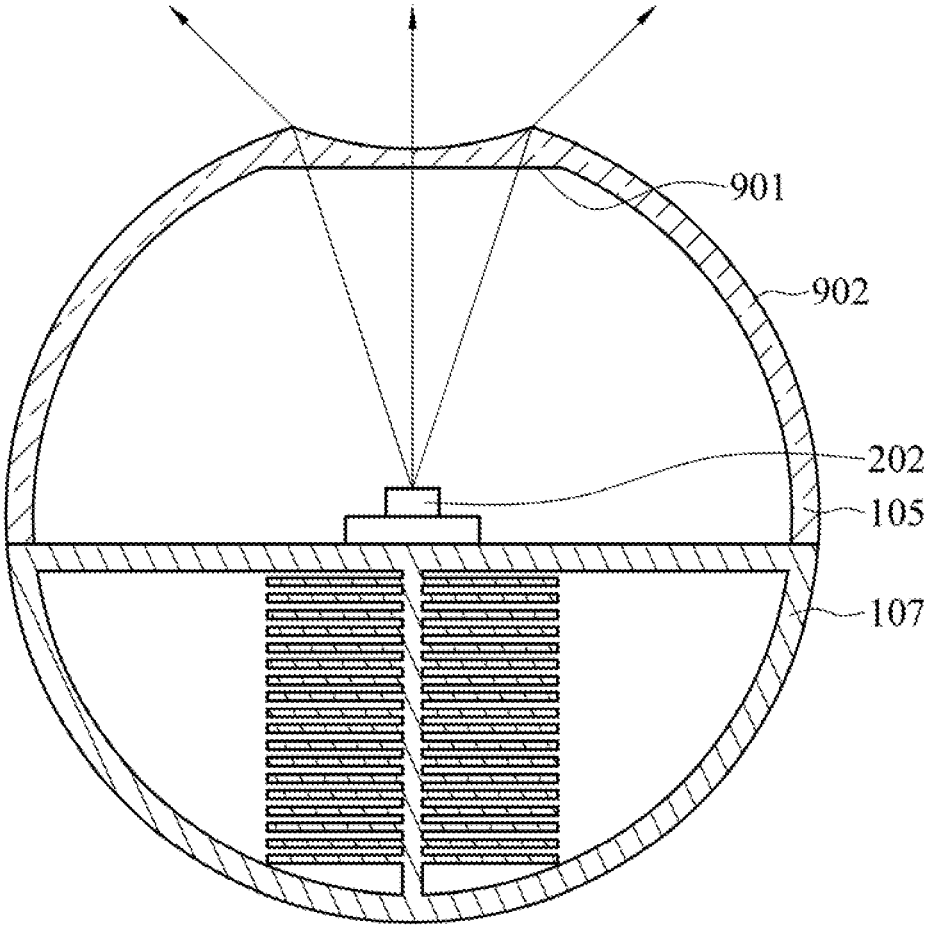
FIG. 14 is a cross-sectional view of the lamp tube in FIG. 1 along 2-2.
Figure 15:
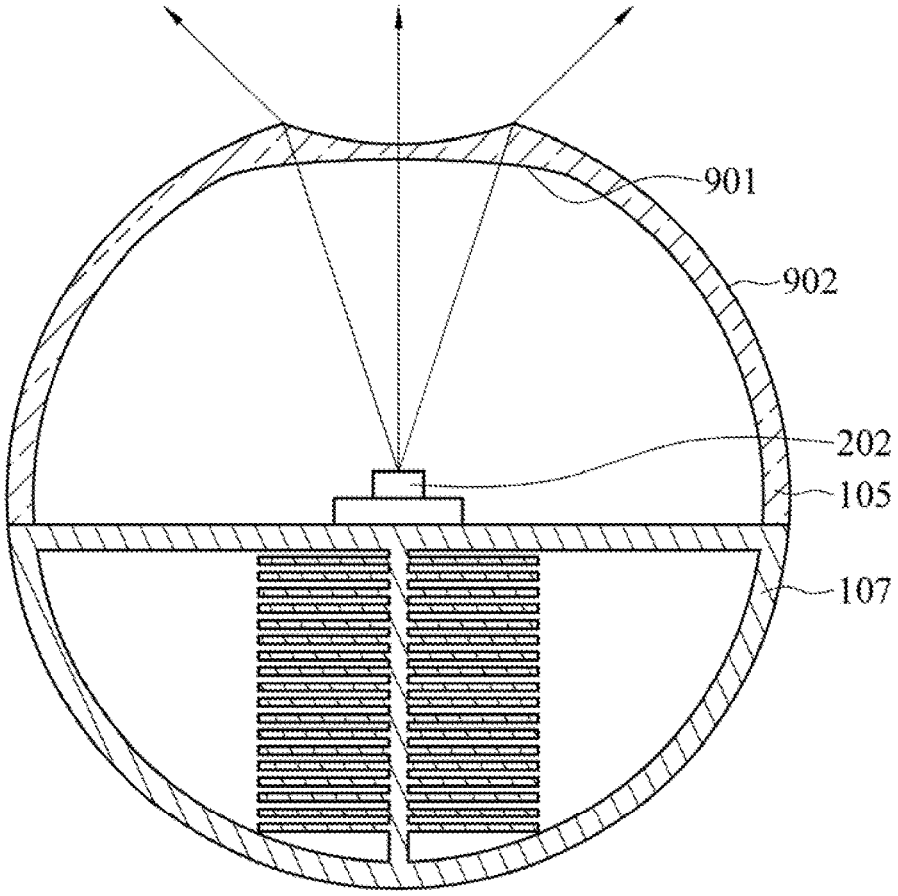
FIG. 15 is a cross-sectional view of the lamp tube in FIG. 1 along 2-2.

In still another embodiment, the outer optical surface is concave but the inner optical surface is either planar or also concave. Turning to FIG. 14, in some embodiments, a portion of the inner optical surface 901 is planar, making a portion of the light transmissive portion 105 a plano-concave cylindrical lens. The portion of the light transmissive portion 105 is thus configured to diverge light coming from the LED light source 202 across a wider filed of angle. Turning to FIG. 15, in other embodiments, the inner optical surface 901 is also concave, making the light transmissive portion 105 a bi-concave cylindrical lens. Functionally similarly, the light transmissive portion 105 is configured to diverge light coming from the LED light source 202 across a wider field of angle.

Having described at least one of the embodiments of the claimed invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents. Specifically, one or more limitations recited throughout the specification can be combined in any level of details to the extent they are described to improve the LED tube lamp. These limitations include, but are not limited to: light transmissive portion and reinforcing portion; curvature of the outer optical surface in relation to that of the inner optical surface of a light transmissive portion; platform and bracing structure; vertical rib, horizontal rib and curvilinear rib; thermally conductive plastic and light transmissive plastic; silicone-based matrix having good thermal conductivity; anti-reflection layer; roughened surface; electrically conductive wiring layer; wiring protection layer; ridge; maintaining stick; shock-preventing safety switch; the ratios and numbers articulated in the preceding paragraphs; and the type of lens formed in the light transmissive portion.

What is claimed is:

1. An LED tube lamp, comprising:

a lamp tube, which includes a light transmissive portion, a reinforcing portion and an end cap; and an LED light assembly, which includes an LED light source and an LED light strip, wherein:

the light transmissive portion is fixedly connected to the reinforcing portion;

the reinforcing portion includes a platform and a bracing structure;

the bracing structure is fixedly connected to the platform and holds the platform in place;

the LED light source is thermally and electrically connected to the LED light strip, which is in turn thermally connected to the reinforcing portion;

the end cap is attached to an end of the lamp tube;

an outer surface of the lamp tube reveals a combination of metallic outer surface and nonmetallic outer surface;

a cross section of the lamp tube perpendicular to the lamp tube's longitudinal axis reveals a combination of metallic object and nonmetallic object;

a hypothetical line D-D horizontally bisects the cross section into an upper segment and a lower segment;

the upper segment and the lower segment have an identical length vertically;

a hypothetical line segment U-L vertically bisects the cross section into a left segment and a right segment;

the left segment and the right segment have an identical length horizontally;

the line segment U-L includes an upper endpoint U and a lower endpoint L, both endpoints falling on a circumference of the cross section;

a length of the line segment U-L from the point U to the point L is H;

a line T-T is a lowest horizontal line on the cross section above which no metallic object is found;
a line B-B is a highest horizontal line on the cross section below which no metallic object is found;
a distance from the line T-T to the line B-B is D3;
a distance from the point U to the line T-T is D1;
a distance from the line B-B to the point L is D2;
a line T'-T' is a lowest horizontal line on the cross section above which no reinforcing portion is found;
a line B'-B' is a highest horizontal line on the cross section below which no reinforcing portion is found;
a distance from the line T'-T' to the line B-B is F;
a distance from the point U to the line T'-T' is F1;
a distance from the line B'-B' to the point L is F2;
a hypothetical closed curve is defined on the cross section by all points whose distance from a center of the cross section is half the distance from the center to the circumference of the cross section;
the curve divides the cross section into a disk containing the center and a ring surrounding the disk;
R1 is a ratio of an overall area of the metallic outer surface to an overall area of the nonmetallic outer surface; and
R1 is from 0.001 to 0.9.

2. The LED tube lamp in claim 1, wherein:
R2 is a ratio of an overall length of the metallic object that shows itself on the circumference of the cross section to an overall length of the nonmetallic object that shows itself on the circumference of the cross section;
R2 is a constant regardless of where the cross section finds itself on the longitudinal axis of the lamp tube; and
R2 is from 0.02 to 0.9.

3. The LED tube lamp in claim 1, wherein:
R3 is a ratio of an overall area of the metallic object on the cross section to an overall area of the nonmetallic object on the cross section;
R3 is a constant regardless of where the cross section finds itself on the longitudinal axis of the lamp tube; and
R3 is from 0.005 to 0.1.

4. The LED tube lamp in claim 1, wherein:
R4 is a ratio of the aggregate of the linear distance around the edge of the metallic object on the cross section to the aggregate of the linear distance around the edge of the nonmetallic object on the cross section;
R4 is a constant regardless of where the cross section finds itself on the longitudinal axis of the lamp tube; and
R4 is from 0.05 to 0.45.

5. The LED tube lamp in claim 1, wherein:
R5 is a ratio of an overall area of the metallic object found in the upper segment to an overall area of the metallic object found in the lower segment;
R5 is a constant regardless of where the cross section finds itself on the longitudinal axis of the lamp tube; and
R5 is from 0 to 0.1.

6. The LED tube lamp in claim 1, wherein:
R6 is a ratio of the aggregate of the linear distance around the edge of the metallic object found in upper segment to the aggregate of the linear distance around the edge of the metallic object found in the lower segment;
R6 is a constant regardless of where the cross section finds itself on the longitudinal axis of the lamp tube; and
R6 is from 0 to 0.5.

7. The LED tube lamp in claim 1, wherein:
R7 is a ratio of an overall area of the metallic object found in the disk to an overall area of the metallic object found in the ring;
R7 is a constant regardless of where the cross section finds itself on the longitudinal axis of the lamp tube; and
R7 is from 0 to 0.1.

8. The LED tube lamp in claim 1, wherein:
R8 is a ratio of the aggregate of the linear distance around the edge of the metallic object found in the disk to the aggregate of the linear distance around the edge of the metallic object found in the ring;
R8 is a constant regardless of where the cross section finds itself on the longitudinal axis of the lamp tube; and
R8 is from 0 to 0.05.

9. The LED tube lamp in claim 1, wherein:
R9 is D3/H;
R9 is a constant regardless of where the cross section finds itself on the longitudinal axis of the lamp tube; and
R9 is from 0.05 to 0.45.

10. The LED tube lamp in claim 1, wherein:
R10 is D1/H;
R10 is a constant regardless of where the cross section finds itself on the longitudinal axis of the lamp tube; and
R10 is from 0.055 to 0.95.

11. The LED tube lamp in claim 1, wherein:
R11 is D2/H;
R11 is a constant regardless of where the cross section finds itself on the longitudinal axis of the lamp tube; and
R11 is from 0.01 to 0.45.

12. The LED tube lamp in claim 1, wherein:
E is a number of types of metal found in the cross section;
E is a constant regardless of where the cross section finds itself on the longitudinal axis of the lamp tube; and
E is from 2 to 10.

13. The LED tube lamp in claim 1, wherein:
R12 is a ratio of an overall area of the opaque outer surface to an overall area of the translucent outer surface; and
R12 is from 0.05 to 0.99.

14. The LED tube lamp in claim 1, wherein:
R13 is a ratio of an overall length of the opaque object that shows itself on the circumference of the cross section to an overall length of the translucent object that shows itself on the circumference of the cross section;
R13 is a constant regardless of where the cross section finds itself on the longitudinal axis of the lamp tube; and
R13 is from 0.05 to 0.99.

15. The LED tube lamp in claim 1, wherein:
R14 is a ratio of an overall area of the reinforcing portion that shows itself on the outer surface of the lamp tube to an overall area of the light transmissive portion that shows itself on the outer surface of the lamp tube; and
R14 is from 0.02 to 1.65.

16. The LED tube lamp in claim 1, wherein:
R15 is a ratio of an overall length of the reinforcing portion that shows itself on the circumference of the cross section to an overall length of the light transmissive portion that shows itself on the circumference of the cross section;
R15 is a constant regardless of where the cross section finds itself on the longitudinal axis of the lamp tube; and
R15 is from 0.02 to 1.65.

17. The LED tube lamp in claim 1, wherein:
R16 is a ratio of an overall area of the reinforcing portion on the cross section to an overall area of the light transmissive portion on the cross section;

R16 is a constant regardless of where the cross section finds itself on the longitudinal axis of the lamp tube; and R16 is from 0.02 to 4.

18. The LED tube lamp in claim 1, wherein:

R17 is a ratio of the aggregate of the linear distance around the edge of the reinforcing portion on the cross section to the aggregate of the linear distance around the edge of the light transmissive portion on the cross section;

R17 is a constant regardless of where the cross section finds itself on the longitudinal axis of the lamp tube; and R17 is from 0.02 to 1.

19. The LED tube lamp in claim 1, wherein:

R18 is F/H;

R18 is a constant regardless of where the cross section finds itself on the longitudinal axis of the lamp tube; and R18 is from 0.05 to 0.4.

20. The LED tube lamp in claim 1, wherein:

R19 is F1/H;

R19 is a constant regardless of where the cross section finds itself on the longitudinal axis of the lamp tube; and R19 is from 0.6 to 0.95.

21. The LED tube lamp in claim 1, wherein:

R20 is F2/H;

R20 is a constant regardless of where the cross section finds itself on the longitudinal axis of the lamp tube; and R20 is from 0 to 0.45.

22. The LED tube lamp in claim 1, wherein:

G is a number of groups of materials categorized by stiffness found in the cross section of the lamp tube;

G is a constant regardless of where the cross section finds itself on the longitudinal axis of the lamp tube; and G is from 5 to 15.

23. The LED tube lamp in claim 22, wherein:

R23 is a ratio of an overall area of all objects having greatest stiffness on the cross section to an overall area of all other objects having less stiffness on the cross section;

R23 is a constant regardless of where the cross section finds itself on the longitudinal axis of the lamp tube; and R23 from 0.005 to 0.1.

24. The LED tube lamp in claim 22, wherein:

R24 is a ratio of the aggregate of the linear distance around the edge of all objects having greatest stiffness on the cross section to the aggregate of the linear distance around the edge of all other objects having less stiffness on the cross section;

R24 is a constant regardless of where the cross section finds itself on the longitudinal axis of the lamp tube; and R24 from 0.005 to 1.65.

25. The LED tube lamp in claim 1, wherein:

the cross section of the lamp tube perpendicular to the lamp tube's longitudinal axis contains a subset of the cross section revealing one of the reinforcing portion, a ridge, a maintaining stick, a protruding bar and a combination selected from above;

the subset of the cross section reveals a combination of objects made of materials having a variety of stiffness;

K is a number of groups of the materials categorized by stiffness found in the subset of the cross section of the lamp tube; and K is from 5 to 15.

26. The LED tube lamp in claim 25, wherein:

R25 is a ratio of an overall area of all objects having greatest stiffness on the subset of the cross section to an overall area of all other objects having less stiffness on the subset of the cross section;

R25 is a constant regardless of where the cross section finds itself on the longitudinal axis of the lamp tube; and R25 is from 0.02 to 4.

27. The LED tube lamp in claim 25, wherein:

R26 is a ratio of the aggregate of the linear distance around the edge of all objects having greatest stiffness on the subset of the cross section to the aggregate of the linear distance around the edge of all other objects having less stiffness on the subset of the cross section;

R26 is a constant regardless of where the cross section finds itself on the longitudinal axis of the lamp tube; and R26 is from 0.02 to 1.

28. The LED tube lamp in claim 1, wherein:

the cross section of the lamp tube perpendicular to the lamp tube's longitudinal axis contains a subset of the cross section revealing one of the reinforcing portion, a ridge, a maintaining stick, a protruding bar and a combination selected from above;

the subset of the cross section reveals a combination of metallic objects and plastic objects;

P is a number of types of metal found in the subset of the cross section;

Q is a number of types of plastic found in subset of the cross section;

P is from 2 to 10; and

Q is from 1 to 5.

29. The LED tube lamp in claim 1, wherein:

the cross section of the lamp tube perpendicular to the lamp tube's longitudinal axis contains a subset of the cross section revealing one of the reinforcing portion, a ridge, a maintaining stick, a protruding bar and a combination selected from above;

the subset of the cross section reveals a combination of metallic objects and nonmetallic objects;

R27 is an overall area of the metallic objects on the subset of the cross section to an overall area of the nonmetallic objects on the subset of the cross section;

R27 is a constant regardless of where the cross section finds itself on the longitudinal axis of the lamp tube; and R27 is from 0 to 0.5.

30. The LED tube lamp in claim 18, wherein:

R21 is a ratio of an overall area of the thermally conductive plastic that shows itself on the outer surface of the lamp tube to an overall area of the light transmissive plastic that shows itself on the outer surface of the lamp tube; and R21 is from 0.05 to 1.

31. The LED tube lamp in claim 18, wherein:

R22 is a ratio of an overall length of the thermally conductive plastic that shows itself on the circumference of the cross section to an overall length of the light transmissive plastic that shows itself on the circumference of the cross section;

R22 is a constant regardless of where the cross section finds itself on the longitudinal axis of the lamp tube; and R22 is from 0.05 to 1.

32. The LED tube lamp in claim 1, wherein:

the end cap is attached to the reinforcing portion with a fastener; and the fastener is non-electrically conductive.

33. The LED tube lamp in claim 1, wherein:

the end cap is attached to the reinforcing portion with a fastener; and the fastener is non-destructive to the end cap and the reinforcing portion.

* * * * *